US009630430B2

(12) United States Patent
Aoki et al.

(10) Patent No.: US 9,630,430 B2
(45) Date of Patent: Apr. 25, 2017

(54) CONVEYOR AND INK-JET RECORDING APPARATUS

(71) Applicant: Brother Kogyo Kabushiki Kaisha, Nagoya-shi, Aichi-ken (JP)

(72) Inventors: Hirotaka Aoki, Nagoya (JP); Kenji Samoto, Nagoya (JP); Shohei Ichikawa, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/087,550

(22) Filed: Mar. 31, 2016

(65) Prior Publication Data

US 2016/0288547 A1 Oct. 6, 2016

(30) Foreign Application Priority Data

Mar. 31, 2015 (JP) ..... 2015-073999
Jun. 18, 2015 (JP) ..... 2015-122654

(51) Int. Cl.
*B41J 23/02* (2006.01)
*B65H 5/06* (2006.01)
(Continued)

(52) U.S. Cl.
CPC ..... *B41J 23/02* (2013.01); *B41J 2/01* (2013.01); *B65H 3/0669* (2013.01); *B65H 5/06* (2013.01); *B65H 7/00* (2013.01); *B65H 2211/00* (2013.01); *B65H 2403/40* (2013.01); *B65H 2403/72* (2013.01); *B65H 2403/73* (2013.01); *B65H 2801/03* (2013.01); *B65H 2801/06* (2013.01)

(58) Field of Classification Search
CPC ... B41J 13/03; B41J 2/01; B41J 23/02; B65H 5/06; B65H 7/00; B65H 2211/00; B65H 2801/03
See application file for complete search history.

(56) References Cited

U.S. PATENT DOCUMENTS 5,971,520 A * 10/1999 Nakahara ..... B41J 23/02 347/30
2001/0005464 A1* 6/2001 Funada ..... B41J 13/103 400/578

(Continued)

FOREIGN PATENT DOCUMENTS

JP 2009-034832 A 2/2009
JP 2013-071407 A 4/2013

*Primary Examiner* — Stephen Meier
*Assistant Examiner* — Alexander D Shenderov
(74) *Attorney, Agent, or Firm* — Banner & Witcoff, Ltd.

(57) ABSTRACT

A conveyor includes: a slide gear and a clutch gear including a first gear and a second gear. The clutch gear includes: a first surface and a second surface provided on one of the first and second gears and facing each other; and a contact member provided on the other of the first and second gears and located between the first surface and the second surface. A controller is configured to: control a motor in a state in which the slide gear and the first gear are in mesh with each other, to rotate the clutch gear to establish a state in which the contact member is not in contact with the first surface or the second surface; and control a sliding mechanism to slide the slide gear in the state in which the contact member is not in contact with the first surface or the second surface.

21 Claims, 19 Drawing Sheets

(51) Int. Cl.

| | |
|---|---|
| ***B65H 7/00*** | (2006.01) |
| ***B41J 2/01*** | (2006.01) |
| ***B65H 3/06*** | (2006.01) |

(56) References Cited

U.S. PATENT DOCUMENTS

| | | | | |
|---|---|---|---|---|
| 2006/0071389 | A1* | 4/2006 | Kozaki | B65H 3/0669 271/9.11 |
| 2008/0157460 | A1* | 7/2008 | Izuchi | B65H 3/0669 271/109 |
| 2009/0035018 | A1 | 2/2009 | Koga et al. | |
| 2009/0035019 | A1 | 2/2009 | Koga et al. | |
| 2012/0161383 | A1* | 6/2012 | Sato | B65H 3/0669 271/10.13 |
| 2013/0126289 | A1* | 5/2013 | Vicente, Jr. | B41J 11/24 192/45.1 |

* cited by examiner

CONVEYOR AND INK-JET RECORDING APPARATUS

CROSS REFERENCE TO RELATED APPLICATION

The present application is based on Japanese Patent Application Nos. 2015-073999, which was filed on Mar. 31, 2015, and 2015-122654 filed on Jun. 18, 2015, the disclosures of which are incorporated herein by reference.

BACKGROUND

Technical Field

The following disclosure relates to a conveyor configured to convey a sheet and to an ink-jet recording apparatus including the conveyor and configured to perform ink-jet recording to record an image on the sheet.

Description of the Related Art

There is conventionally known a conveyor for conveying a sheet. One example of an apparatus including the conveyor is an ink-jet recording apparatus configured to perform ink-jet recording to record an image on the sheet.

As the ink-jet recording apparatus including the conveyor, there is known an image recording apparatus configured to switch power transmission to transmit a driving force of one motor selectively to a plurality of driven members. Specifically, the image recording apparatus includes: a drive gear to which the drive force produced by the motor is transmitted; and a switch gear slidable in axial directions of the drive gear while being in mesh with the drive gear. The image recording apparatus further includes a plurality of receiving gears. The switch gear is slid to come into mesh selectively with one of the receiving gears. Each of the receiving gears transmits the driving force from the switch gear to a corresponding one of the driven members.

SUMMARY

To switch power transmission, however, the above-described image recording apparatus needs to perform a meshing operation for engaging the switch gear with one of the receiving gears well when the switch gear is slid. In the meshing operation, forward rotation and reverse rotation of the switch gear by a particular amount are performed a particular number of times. Thus, the meshing operation requires a long time.

Accordingly, an aspect of the disclosure relates to provide a conveyor and an ink-jet recording apparatus capable of quickly switching power transmission.

In one aspect of the disclosure, a conveyor includes: a slide gear supported slidably in axial directions of a support shaft; a clutch gear including (i) a first gear meshable with the slide gear and (ii) a second gear that is rotated coaxially with the first gear; a motor that applies a driving force to one of the second gear and the slide gear; a driven member that is driven by the driving force transmitted from another of the second gear and the slide gear; a sliding mechanism that slides the slide gear; a roller that conveys a sheet by being rotated by the driving force transmitted from the motor; and a controller configured to control the motor and the sliding mechanism. The clutch gear includes: a first surface and a second surface provided on one of the first gear and the second gear, the first surface and the second surface facing each other in circumferential directions of the one of the first gear and the second gear; and a contact member provided on another of the first gear and the second gear and located between the first surface and the second surface in the circumferential directions, the contact member being contactable with the first surface and the second surface. A distance in the circumferential directions between a contact portion of the contact member which is to contact the first surface and a contact portion of the contact member which is to contact the second surface is less than a distance between the first surface and the second surface in the circumferential directions. The controller is configured to perform: controlling the motor in a state in which the slide gear and the first gear are in mesh with each other, to cause rotation of the clutch gear to establish a state in which the contact member is not in contact with any of the first surface and the second surface; and controlling the sliding mechanism to cause sliding of the slide gear in the state in which the contact member is not in contact with any of the first surface and the second surface.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

First Embodiment

Hereinafter, there will be described a first embodiment. It is to be understood that the following embodiment is described only by way of example, and the disclosure may be otherwise embodied with various modifications without departing from the scope and spirit of the disclosure. A multi-function peripheral (MFP) 10 is used in a state illustrated in FIG. 1. In the present embodiment, arrows illustrated in FIG. 1 indicate up and down directions 7, front and rear directions 8, and right and left directions 9. In the following explanation, the up and down directions 7 are defined as up and down directions of the MFP 10 illustrated in FIG. 1, i.e., the MFP 10 being in a normal state. Also, the front and rear directions 8 are defined by regarding a side of the MFP 10 on which an opening 13 is formed as a front side, and the right and left directions 9 are defined in a state in which the MFP 10 is viewed from the front side.

Overall Construction of MFP 10

Figure 1:
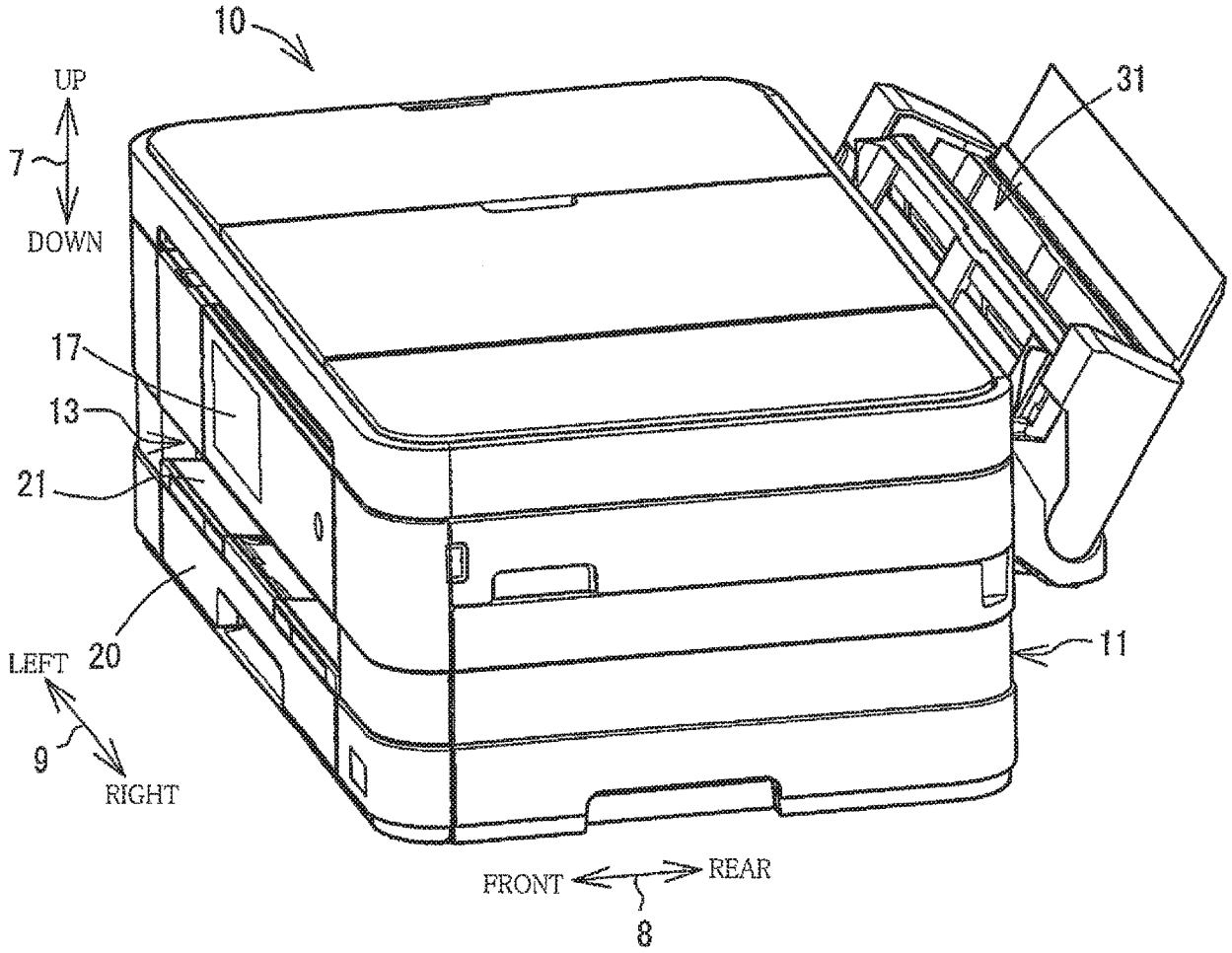
FIG. 1 is a perspective view of a multi-function peripheral (MFP) according to a first embodiment.

As illustrated in FIG. 1, the MFP 10 as one example of an ink-jet recording apparatus has a generally rectangular parallelepiped shape. The MFP 10 has various functions such as a facsimile function and a printing function. The MFP 10 includes an ink-jet printer 11 at its lower portion. The printer 11 records an image on one surface of a sheet 12 (see FIG. 2). It is noted that the printer 11 may be configured to record images respectively on both surfaces of the sheet 12.

The printer 11 includes a conveyor configured to convey the sheet 12, a recording device 24 configured to record an image on the sheet 12 conveyed by the conveyor, and a platen 42 configured to support the sheet 12 conveyed by the conveyor.

Figure 2:
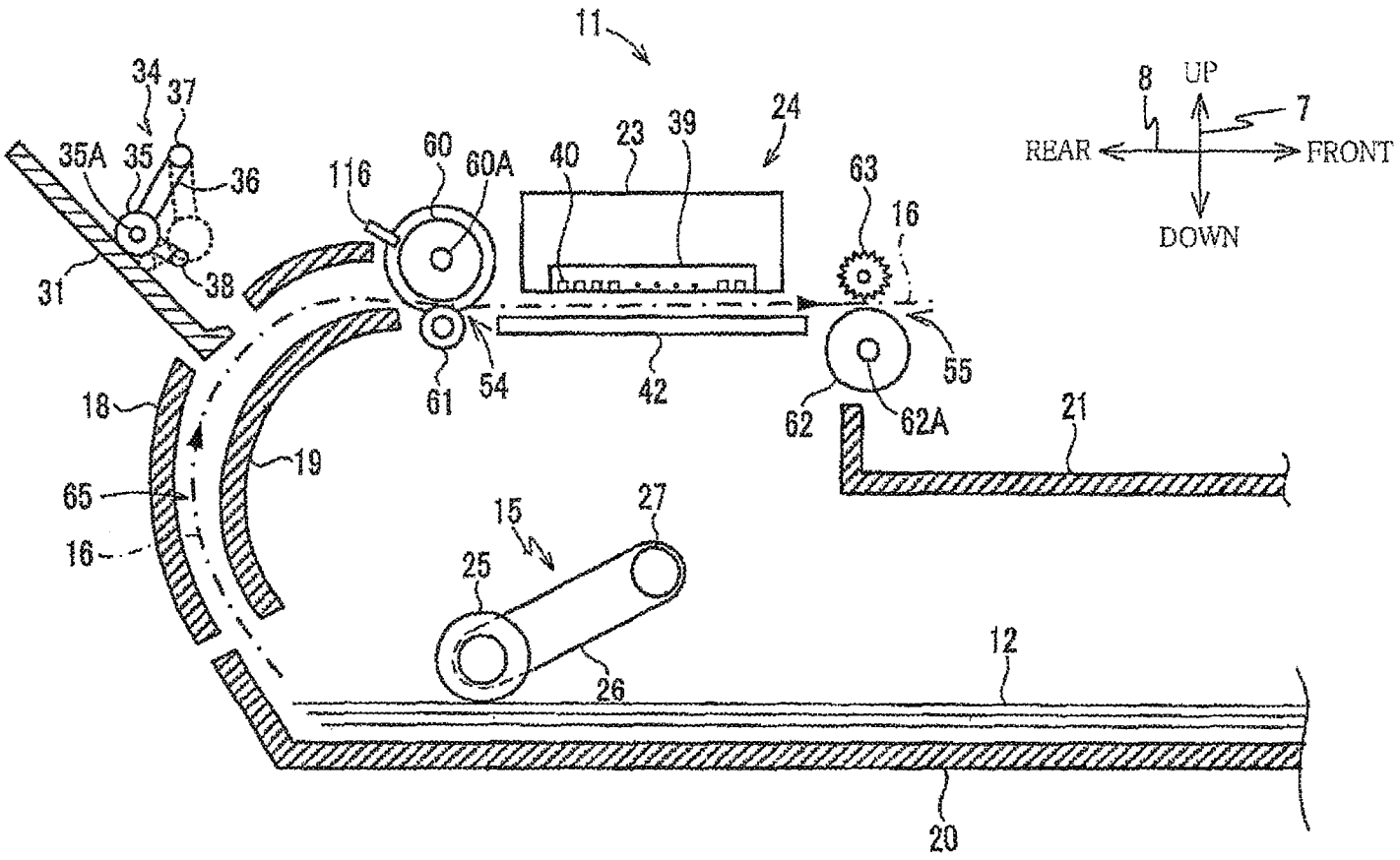
FIG. 2 is an elevational view in vertical cross section schematically illustrating an internal structure of a printer.
Figure 4:
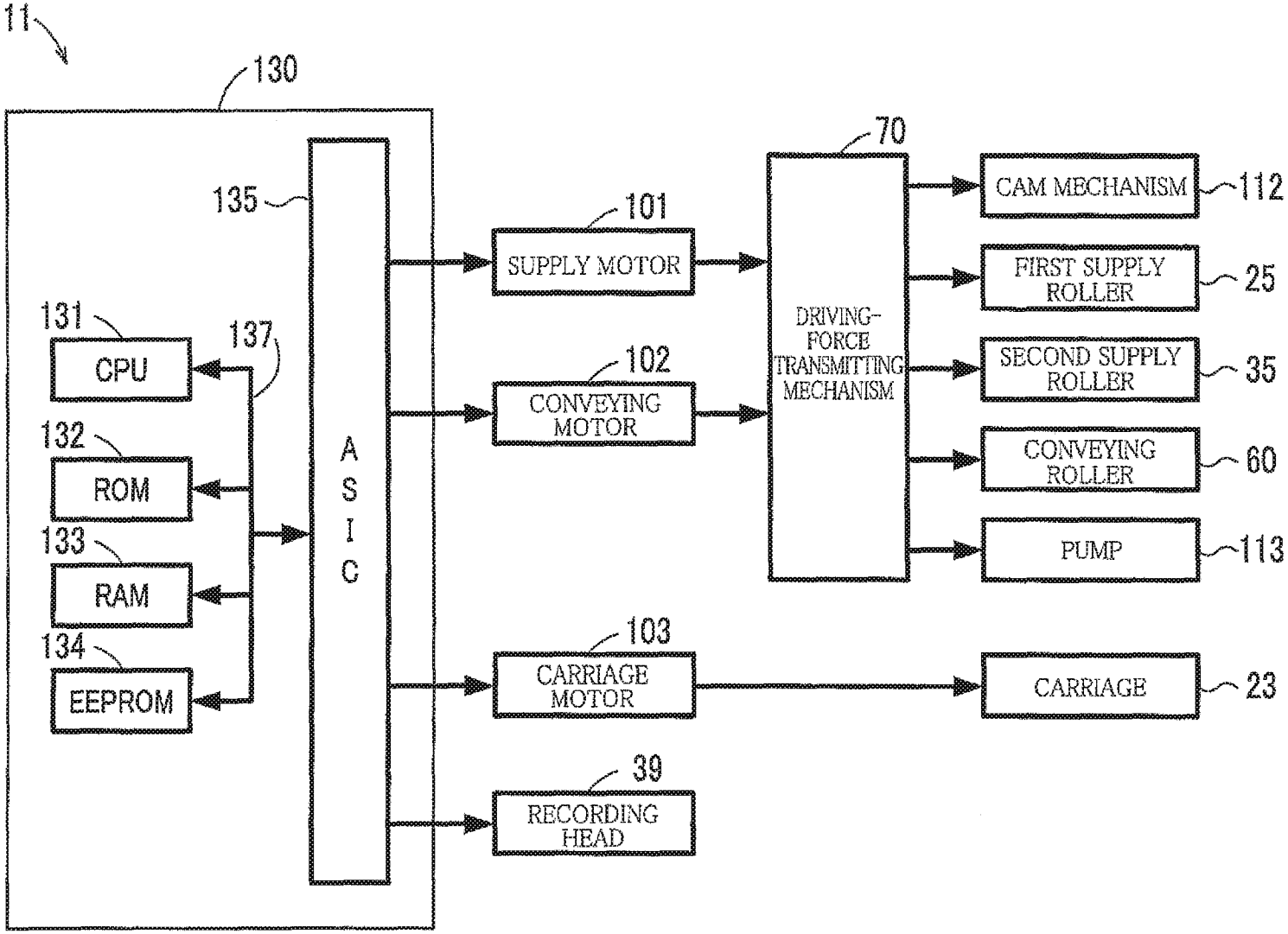
FIG. 4 is a block diagram illustrating the printer.

As illustrated in FIG. 2, the conveyor includes a first sheet supplier 15, a second sheet supplier 34, a supply tray 20 as one example of a tray, a multi-purpose (MP) tray 31 as one example of the tray), an output tray 21, a conveying roller unit 54, and an output roller unit 55. As illustrated in FIG. 4, the conveyor includes a supply motor 101 as one example of a second motor, a conveying motor 102 as one example of a first motor, a controller 130, a driving-force transmitting mechanism 70, and a maintenance mechanism 110.

Supply Tray 20, Output Tray 21, and MP Tray 31

As illustrated in FIGS. 1 and 2, the supply tray 20 is inserted into and removed from the printer 11 in the front and rear directions 8 through the opening 13 formed in a front surface of the printer 11. The supply tray 20 is capable of supporting a plurality of sheets 12 stacked on each other. The output tray 21 is disposed over the supply tray 20. The output tray 21 supports the sheet 12 discharged by the output roller unit 55 through the opening 13. The MP tray 31 is disposed so as to be inclined upward and rearward from a rear surface of the printer 11. The MP tray 31 is capable of supporting a plurality of sheets 12 stacked on each other.

First Sheet Supplier 15 and Second Sheet Supplier 34

As illustrated in FIG. 2, the first sheet supplier 15 includes: a first supply roller 25 as one example of a roller and a supply roller; a supply arm 26; and a shaft 27. The first supply roller 25 is rotatably supported at a distal end portion of the supply arm 26. The first supply roller 25 is rotated forwardly by forward rotation of the supply motor 101 (see FIGS. 4 and 9). The forward rotation of the first supply roller 25 supplies the sheet 12 from the supply tray 20 toward a conveyance path 65, which will be described below, in a conveying direction 16. Power transmission from the supply motor 101 to the first supply roller 25 will be explained later in detail. The supply arm 26 is pivotably supported by the shaft 27 supported by a frame of the printer 11.

The second sheet supplier 34 supplies an uppermost one of the sheets 12 stacked on the MP tray 31, to the conveyance path 65. The second sheet supplier 34 includes: a second supply roller 35 as another example of the roller and the supply roller; a supply arm 36; and a shaft 37. The second supply roller 35, the supply arm 36, and the shaft 37 are similar in construction to the first supply roller 25, the supply arm 26, and the shaft 27 of the first sheet supplier 15, respectively. The second sheet supplier 34 further includes a lifter 38 pivotably supported by a shaft 35A of the second supply roller 35. The lifter 38 pivots between a non-supply position indicated by the broken lines in FIG. 2 and a supply position indicated by the solid lines in FIG. 2. At the non-supply position, the lifter 38 is held in contact with the MP tray 31 (or the sheet 12 when the sheet or sheets 12 are supported on the MP tray 31). At the supply position, the lifter 38 is spaced apart from the MP tray 31 (or the sheet 12 when the sheet or sheets 12 are supported on the MP tray 31). A free end of the lifter 38 is located outside an outer circumferential surface of the second supply roller 35. With this construction, the lifter 38 located at the non-supply position keeps the second supply roller 35 to be spaced apart from the sheets 12 placed on the MP tray 31. The lifter 38 at the supply position holds the second supply roller 35 in contact with an uppermost one of the sheets 12 placed on the MP tray 31.

When the supply motor 101 (see FIG. 4) is rotated forwardly, the lifter 38 pivots from the supply position to the non-supply position. When the supply motor 101 is rotated reversely, the lifter 38 pivots from the non-supply position to the supply position. Also, when the supply motor 101 is rotated reversely, the second supply roller 35 is rotated forwardly to convey the sheet 12 from the MP tray 31 in the conveying direction 16. Power transmission from the supply motor 101 to the lifter 38 and the second supply roller 35 will be explained later in detail.

Conveyance Path 65

As illustrated in FIG. 2, the printer 11 has the conveyance path 65 through which the sheet 12 is to be conveyed. The conveyance path 65 is defined by guide members 18, 19 provided in the printer 11 so as to be opposed to each other with a predetermined distance therebetween. One-dot-chain-line arrows in FIG. 2 indicate the conveying direction 16 in which the sheet 12 is to be conveyed through the conveyance path 65.

In the present embodiment, the conveyance path 65 includes a curved conveyance path and a straight conveyance path. The curved conveyance path is provided at a rear portion of the printer 11 so as to make an upward U-turn. The straight conveyance path extends from the conveying roller unit 54 to the output tray 21 via the recording device 24 and the output roller unit 55.

Conveying Roller Unit 54

As illustrated in FIG. 2, the conveying roller unit 54 is disposed upstream of the recording device 24 in the conveying direction 16. The conveying roller unit 54 includes a conveying roller 60 (as another example of the roller) and a pinch roller 61 which are opposed to each other. The conveying roller 60 is driven and rotated by the conveying motor 102 (see FIGS. 4 and 8). The pinch roller 61 is rotated by rotation of the conveying roller 60. The conveying roller 60 and the pinch roller 61 are rotated forwardly by a forward driving force transmitted from the conveying motor 102. When the conveying roller 60 and the pinch roller 61 are rotated forwardly in a state in which the sheet 12 is nipped therebetween, the conveying roller 60 and the pinch roller 61 convey the nipped sheet 12 in the conveying direction 16. That is, the conveying roller 60 conveys the sheet 12 by being rotated in a state in which the conveying roller 60 is held in contact with the sheet 12 on the conveyance path 65. Upon receiving a reverse driving force transmitted from the conveying motor 102, the conveying roller 60 and the pinch roller 61 are rotated reversely.

Output Roller Unit 55

As illustrated in FIG. 2, the output roller unit 55 is disposed downstream of the recording device 24 in the conveying direction 16. The output roller unit 55 includes an output roller 62 and a spur 63 which are opposed to each other. The output roller 62 is driven and rotated by the conveying motor 102 (see FIGS. 4 and 8). The spur 63 is rotated by rotation of the output roller 62. Upon receiving the forward driving force transmitted from the conveying motor 102 in a state in which the sheet 12 is nipped between the output roller 62 and the spur 63, the output roller 62 and the spur 63 are rotated forwardly to convey the nipped sheet 12 in the conveying direction 16. Upon receiving the reverse driving force transmitted from the conveying motor 102, the output roller 62 and the spur 63 are rotated reversely.

Recording Device 24

Figure 3:
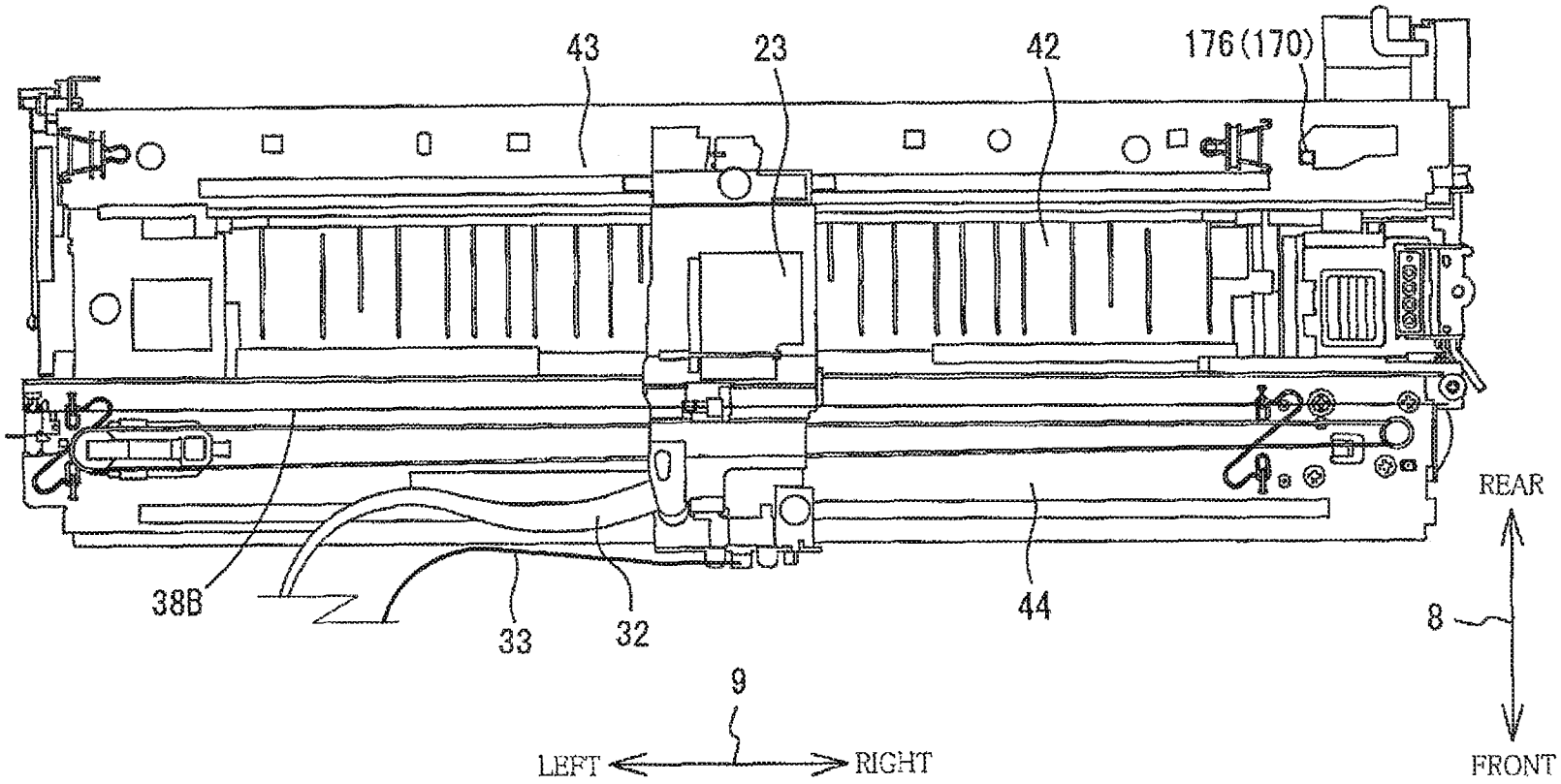
FIG. 3 is a plan view of a carriage and guide rails.

As illustrated in FIG. 2, the recording device 24 is disposed between the conveying roller unit 54 and the output roller unit 55 in the conveying direction 16. The recording device 24 is opposed to the platen 42 in the up and down directions 7. The recording device 24 includes a carriage 23 and a recording head 39. As illustrated in FIG. 3, an ink tube 32 and a flexible flat cable 33 extend from the carriage 23. Ink is supplied from an ink cartridge to the recording head 39 through the ink tube 32. The flexible flat cable 33 electrically connects between the recording head 39 and a control board on which the controller 130 is mounted.

As illustrated in FIG. 3, the carriage 23 is supported by guide rails 43, 44 spaced apart from each other in the front and rear directions 8 and each extending in the right and left directions 9. The carriage 23 is coupled to a well-known belt mechanism provided on the guide rail 44. It is noted that this belt mechanism is driven by a carriage motor 103 (see FIG. 4). That is, when the carriage motor 103 is driven, and the belt mechanism is rotated, the carriage 23 is reciprocated in main scanning directions coinciding with the right and left directions 9.

As illustrated in FIG. 2, the recording head 39 is mounted on the carriage 23. A lower surface of the recording head 39 has a multiplicity of nozzles 40. The recording head 39 ejects fine ink droplets from the nozzles 40. During movement of the carriage 23, the recording head 39 ejects the ink droplets onto the sheet 12 conveyed by the conveying roller unit 54 and supported on the platen 42. As a result, an image is recorded on the sheet 12.

During image recording on the sheet 12, the carriage 23 is reciprocated in the right and left directions 9 within an area where the recording head 39 can eject the ink onto the sheet 12. Specifically, the carriage 23 is reciprocated within the area where at least a portion of the recording head 39 is located just above the conveyance path 65 and the platen 42. The area where the carriage 23 is reciprocated during image recording will be hereinafter referred to as "printing area".

The carriage 23 is movable to a position located to the right of the printing area. In other words, the carriage 23 is movable to an outside of the printing area. This position of the carriage 23 which is located to the right of the printing area may be hereinafter referred to as "home position". That is, the carriage 23 is movable over the printing area and the home position. It is noted that the home position may be located to the left of the printing area.

Platen 42

As illustrated in FIG. 2, the platen 42 is disposed between the conveying roller unit 54 and the output roller unit 55 in the conveying direction 16. The platen 42 is opposed to the recording device 24 in the up and down directions 7 and supports a lower surface of the sheet 12 conveyed by the conveying roller unit 54.

Maintenance Mechanism 110 and Cap 114

Figure 5:
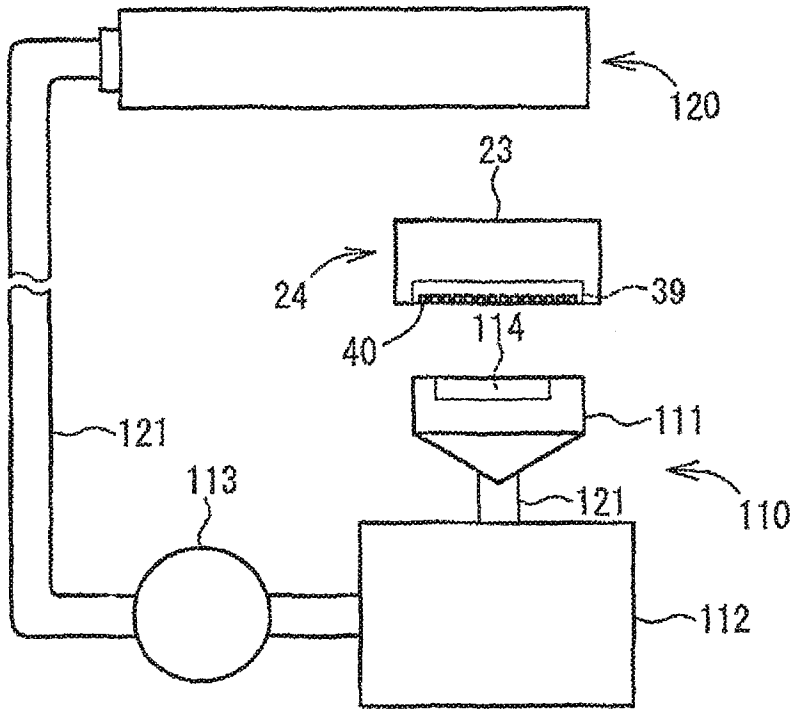
FIG. 5 is a schematic view illustrating constructions of a maintenance mechanism and a waste ink tank.

The maintenance mechanism 110 illustrated in FIG. 5 performs maintenance of the recording head 39. The maintenance mechanism 110 is one example of a driven member and a first driven member. In the present embodiment, the maintenance mechanism 110 sucks the ink from the nozzles 40 of the recording head 39 and discharges the sucked ink to a waste ink tank 120 through a tube 121.

The maintenance mechanism 110 is disposed under the moving path of the carriage 23 and to the right of a right end of the platen 42. That is, the maintenance mechanism 110 is disposed outside the conveyance path 65 in the right and left directions 9 and to the right of the printing area. The maintenance mechanism 110 is disposed just under the carriage 23 located at the home position.

It is noted that FIG. 5 schematically illustrates the waste ink tank 120 to indicate that the maintenance mechanism 110 and the waste ink tank 120 are connected to each other by the tube 121. However, a positional relationship between the waste ink tank 120 and other components in FIG. 5 does not indicate their actual arrangement.

The maintenance mechanism 110 includes: a movable member 111; a cam mechanism 112 configured to move the movable member 111 in the up and down directions 7; the tube 121 through which the ink flows; and a pump 113 configured to suck the ink.

The movable member 111 is constituted by a rubber cap 114 as another example of the driven member and one example of a second driven member. The cap 114 is provided so as to be opposed to the carriage 23 located at the home position in the up and down directions 7. Specifically, the cap 114 is provided so as to be opposed in the up and down directions 7 to the nozzles 40 formed in the lower surface of the recording head 39 mounted on the carriage 23 located at the home position. The cam mechanism 112 is driven by the supply motor 101 (see FIG. 4) to move the movable member 111 in the up and down directions 7. When the movable member 111 is moved upward, the cap 114 is brought into contact with the lower surface of the recording head 39 mounted on the carriage 23 located at the home position. As a result, the cap 114 covers the nozzles 40. With the construction as described above, a driving force transmitted from the supply motor 101 moves the cap 114 between a separated position spaced apart from the nozzles 40 and a covering position at which the cap 114 is in contact with the lower surface of the recording head 39 to cover the nozzles 40.

One end of the tube 121 is connected to the cap 114. The tube 121 is a flexible resin tube. The other end of the tube 121 is connected to the waste ink tank 120.

The pump 113 is a rotary tube pump in the present embodiment. The pump 113 includes: a casing having an inner wall surface; and a rotor which is rotated and rolled along the inner wall surface. The tube 121 is disposed between the rotor and the inner wall surface. The rotor is driven by the conveying motor 102 (see FIGS. 4 and 8). The rotor being driven squeezes the tube 121, so that the ink in the nozzles 40 is sucked into the tube 121, and the ink in the tube 121 is discharged from an upstream side (the cap 114) toward a downstream side (the waste ink tank 120).

The waste ink tank 120 is shaped like a generally rectangular parallelepiped box having an inner space. An ink absorber, not illustrated, is disposed in the inner space. This ink absorber absorbs the ink, whereby the waste ink tank 120 is capable of storing the ink sucked from the nozzles 40.

Power transmission from the conveying motor 102 to the pump 113 and power transmission from the supply motor 101 to the cam mechanism 112 (the cap 114) will be explained later in detail.

Driving-Force Transmitting Mechanism 70

The driving-force transmitting mechanism 70 is constituted by combination of all or some of gears, pulleys, endless belts, and other similar components. As illustrated in FIGS. 6-9, the driving-force transmitting mechanism 70 includes a first transmitter 181, a second transmitter 182, a third transmitter 183, a fourth transmitter 184, a fifth transmitter 185, a sixth transmitter 186, a seventh transmitter 187, and a switching mechanism 170. It is noted that the construction of the driving-force transmitting mechanism 70 such as the number of gears is not limited to a construction which will be described below.

The first transmitter 181 transmits the driving force produced by the conveying motor 102 to the conveying roller 60 and the switching mechanism 170. The second transmitter 182 transmits the driving force produced by the supply motor 101 to the switching mechanism 170. The third transmitter 183 transmits the driving force produced by the conveying motor 102 from the conveying roller 60 to the output roller 62. The fourth transmitter 184 transmits the driving force produced by the conveying motor 102 from the switching mechanism 170 to the pump 113. The fifth transmitter 185 transmits the driving force produced by the supply motor 101 from the switching mechanism 170 to the cam mechanism 112. The sixth transmitter 186 transmits the driving force produced by the supply motor 101 from the switching mechanism 170 to the first supply roller 25. The seventh transmitter 187 transmits the driving force produced by the supply motor 101 from the switching mechanism 170 to the second supply roller 35. The switching mechanism 170 switches a destination of the driving force produced by each of the supply motor 101 and the conveying motor 102.

First Transmitter 181

Figure 6:
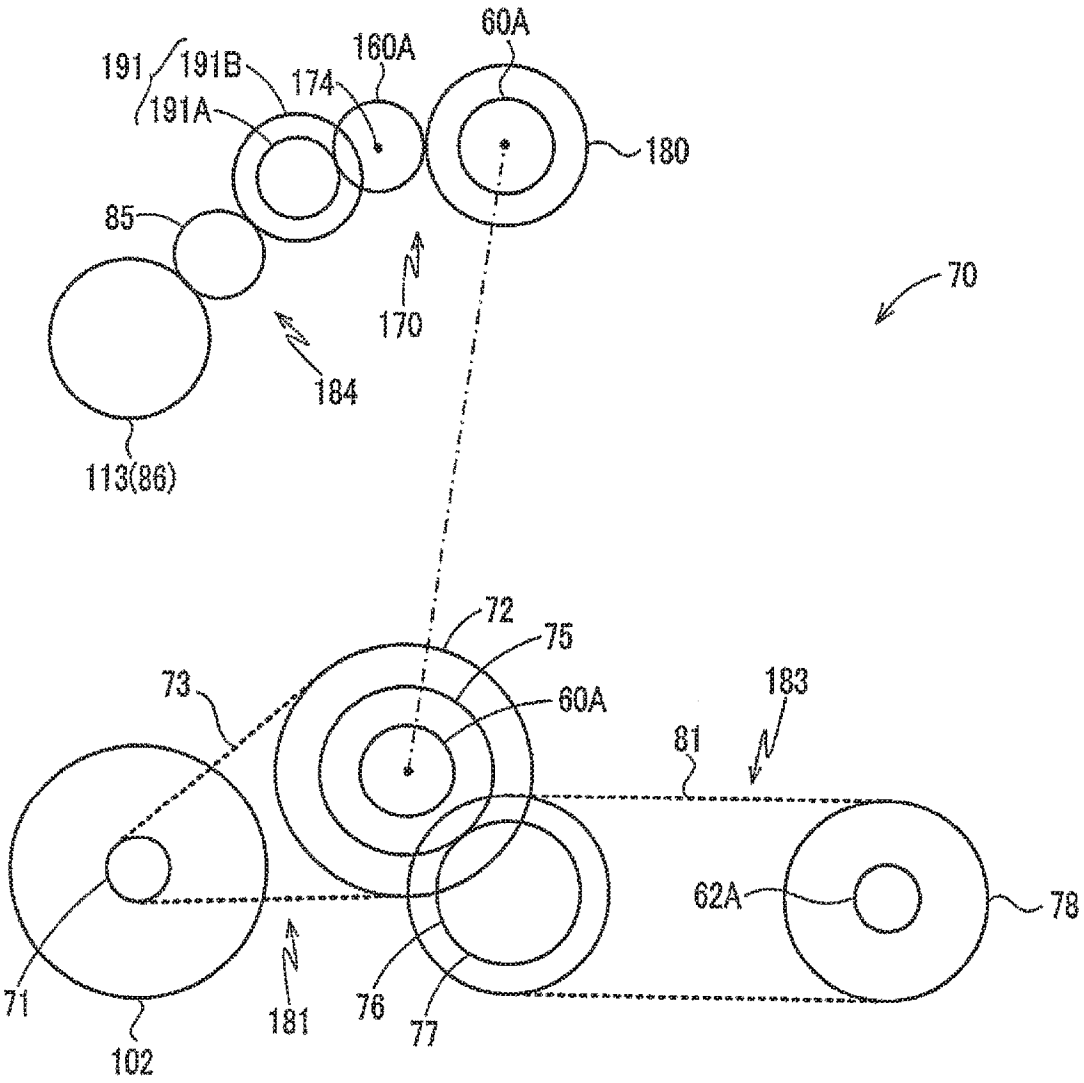
FIG. 6 is a schematic view of a first transmitter, a third transmitter, a fourth transmitter, and a switching mechanism.
Figure 8:
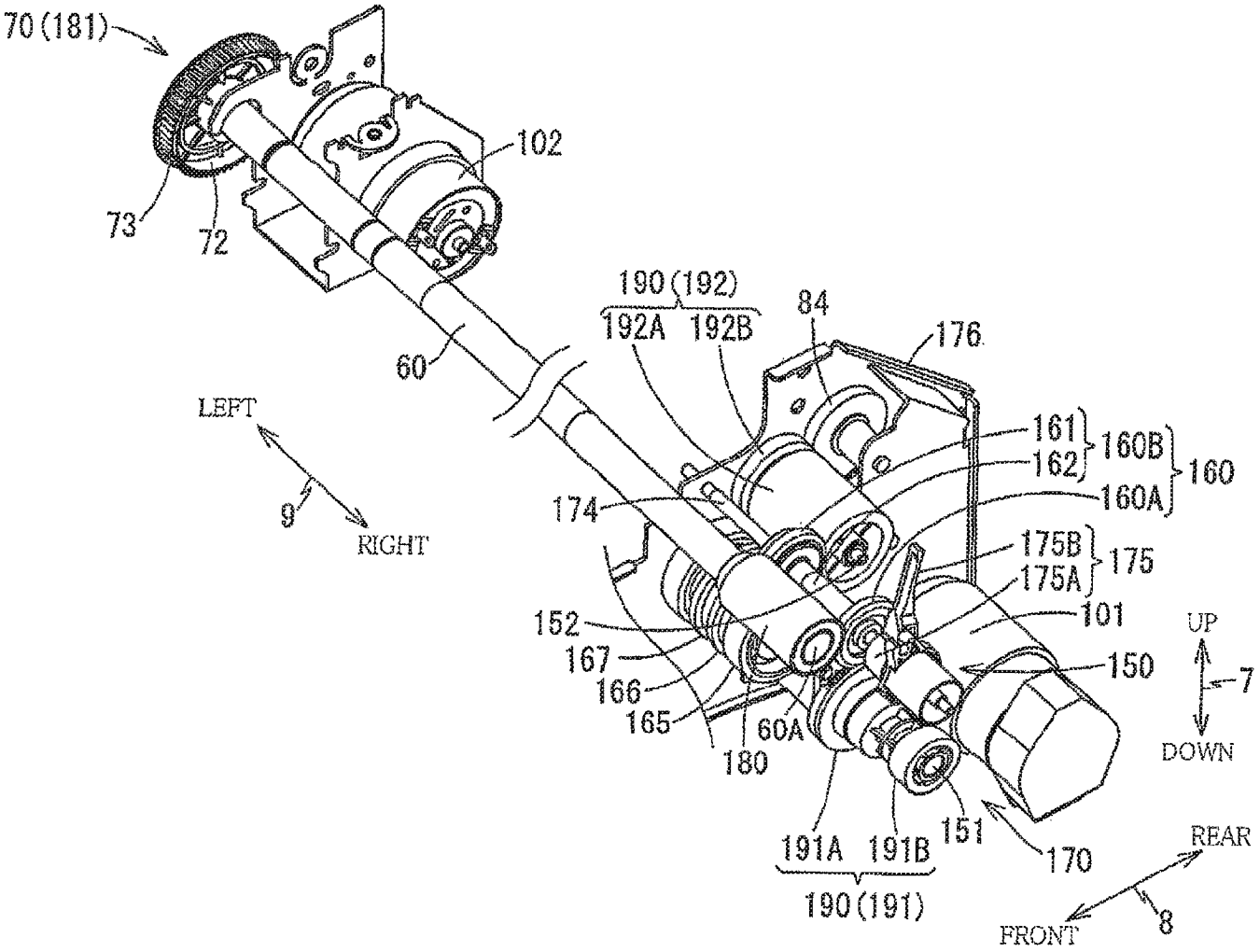
FIG. 8 is a perspective view of the switching mechanism, a conveying roller, and components near the switching mechanism and the conveying roller.

As illustrated in FIGS. 6 and 8, the first transmitter 181 includes: a pulley 71 which is rotated together with a shaft of the conveying motor 102; a pulley 72 which is rotated together with a shaft 60A of the conveying roller 60 as one example of a roller shaft; and an endless belt 73 looped over the pulleys 71, 72. With this construction, the conveying roller 60 is rotated forwardly by the forward driving force transmitted from the conveying motor 102 and is rotated reversely by the reverse driving force transmitted from the conveying motor 102. A roller gear 180 of the switching mechanism 170 is rotated together with the shaft 60A of the conveying roller 60. Thus, when the conveying roller 60 is rotated, the roller gear 180 is also rotated. With the construction as described above, the first transmitter 181 transmits the driving force produced by the conveying motor 102 to the conveying roller 60 and the switching mechanism 170.

Second Transmitter 182

Figure 9:
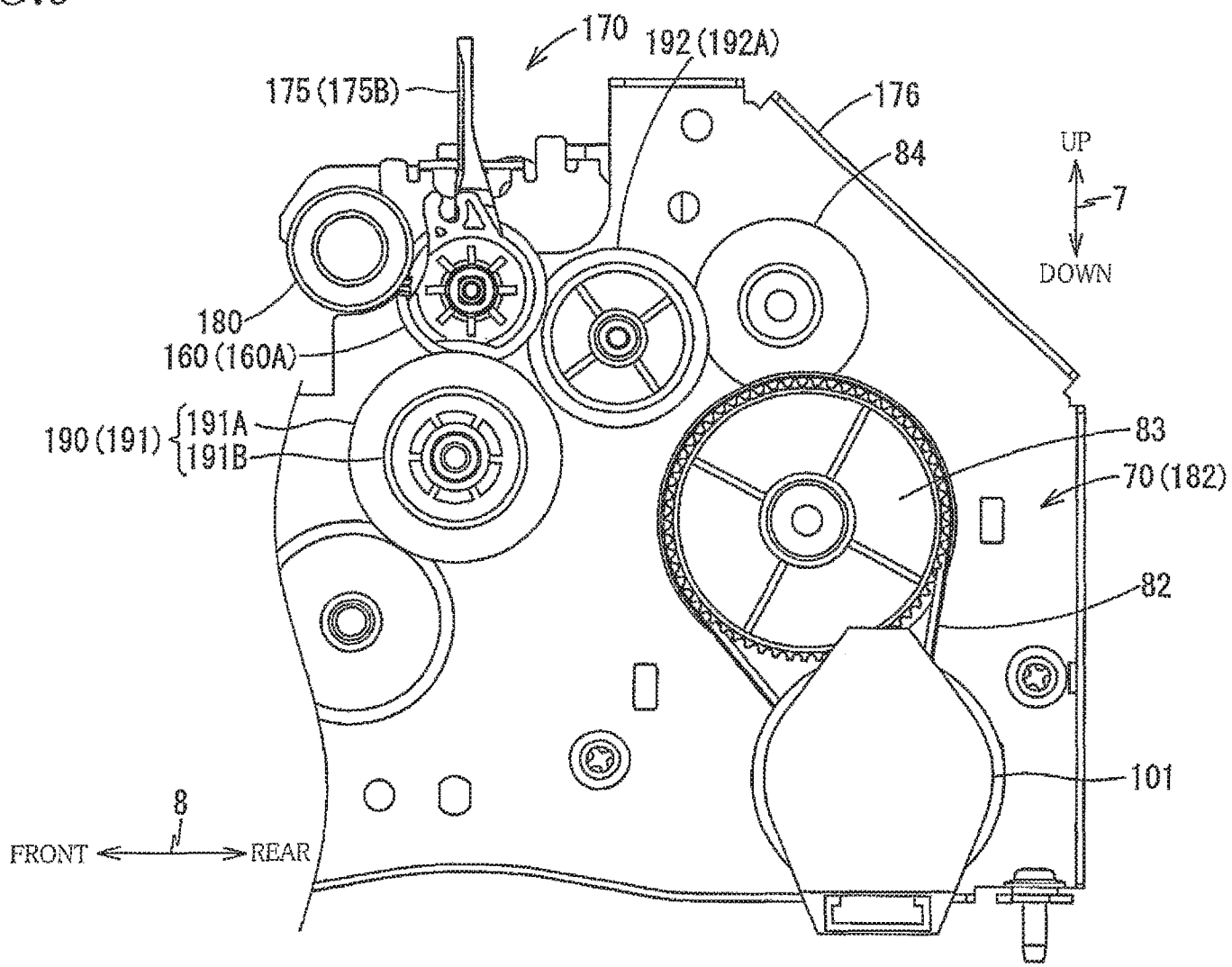
FIG. 9 is a right side view corresponding to FIG. 8.

As illustrated in FIGS. 7 and 9, the second transmitter 182 includes: a pulley 79 which is rotated together with a shaft of the supply motor 101; a pulley 80; an endless belt 82 looped over the pulleys 79, 80; a gear 83 which is rotated together with a shaft of the pulley 80; and a gear 84 meshed with the gear 83. The gear 84 is meshed with a second gear 192B of a second clutch gear 192 of the switching mechanism 170. With this construction, the supply motor 101 applies its driving force to the second clutch gear 192. Specifically, the second clutch gear 192 is rotated forwardly by a forward driving force transmitted from the supply motor 101 and is rotated reversely by a reverse driving force transmitted from the supply motor 101. With the construction as described above, the second transmitter 182 transmits the driving force produced by the supply motor 101 to the switching mechanism 170.

Third Transmitter 183

As illustrated in FIG. 6, the third transmitter 183 includes gears 75, 76 meshed with each other, pulleys 77, 78, and an endless belt 81. The gear 75 is in mesh with the gear 76 and rotated together with the shaft 60A of the conveying roller 60. The gear 76 and the pulley 77 are rotated together with each other about the same axis. The pulley 78 is mounted on a shaft 62A of the output roller 62. The belt 81 is looped over the pulleys 77, 78. With this construction, the output roller 62 is rotated forwardly by the forward driving force transmitted from the conveying motor 102 and is rotated reversely by the reverse driving force transmitted from the conveying motor 102. With the construction as described above, the third transmitter 183 transmits the driving force produced by the conveying motor 102 from the conveying roller 60 to the output roller 62.

Fourth Transmitter 184

As illustrated in FIG. 6, the fourth transmitter 184 includes: a gear 85 meshed with a second gear 191B of a first clutch gear 191 of the switching mechanism 170; and a gear 86 which is meshed with the gear 85 and rotated together with a shaft of the rotor of the pump 113. With this construction, when the forward driving force is transmitted to the pump 113 from the second gear 191B of the first clutch gear 191, the pump 113 performs the sucking operation for sucking the ink. When the reverse driving force is transmitted to the pump 113 from the second gear 191B, the pump 113 performs an air communicating operation for establish a state in which the pump 113 communicates with air. With this construction, the pump 113 is driven by the driving force transmitted from the second gear 191B of the first clutch gear 191. The driving force is transmitted to the second gear 191B from the conveying motor 102 via the roller gear 180, a first slide gear 160A, and a first gear 191A of the first clutch gear 191. Specifically, the roller gear 180 is meshed with the first slide gear 160A. The first slide gear 160A is meshable with the first gear 191A. The second gear 191B is rotatable together with the first gear 191A. It is noted that the first slide gear 160A and the first clutch gear 191 will be described later in detail. With the construction as described above, the fourth transmitter 184 transmits the driving force produced by the conveying motor 102 from the switching mechanism 170 to the pump 113.

Fifth Transmitter 185

Figure 7A:
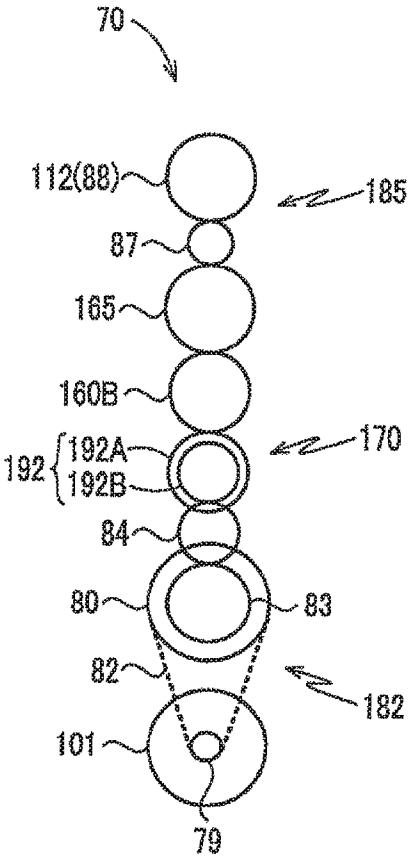
FIG. 7A is a schematic view of a second transmitter, a fifth transmitter, and the switching mechanism.

As illustrated in FIG. 7A, the fifth transmitter 185 includes: a gear 87 meshed with a receiving gear 165 of the switching mechanism 170; and a gear 88 provided on the cam mechanism 112 and meshed with the gear 87. It is noted that the driving force is transmitted to the receiving gear 165 from the supply motor 101 via the second clutch gear 192 and a second slide gear 160B. Specifically, a first gear 192A of the second clutch gear 192 is rotatable together with the second gear 192B to which the driving force produced by the supply motor 101 is transmitted by the second transmitter 182. The first gear 192A is meshed with the second slide gear 160B. The second slide gear 160B is meshable with the receiving gear 165. It is noted that the second slide gear 160B and the second clutch gear 192 will be described later in detail. Rotation of the gear 88 drives the cam mechanism 112 to elevate or lower the movable member 111 including the cap 114. With the construction as described above, the fifth transmitter 185 transmits the driving force produced by the supply motor 101 (the reverse driving force in the present embodiment) from the switching mechanism 170 to the cam mechanism 112.

Sixth Transmitter 186

Figure 7B:
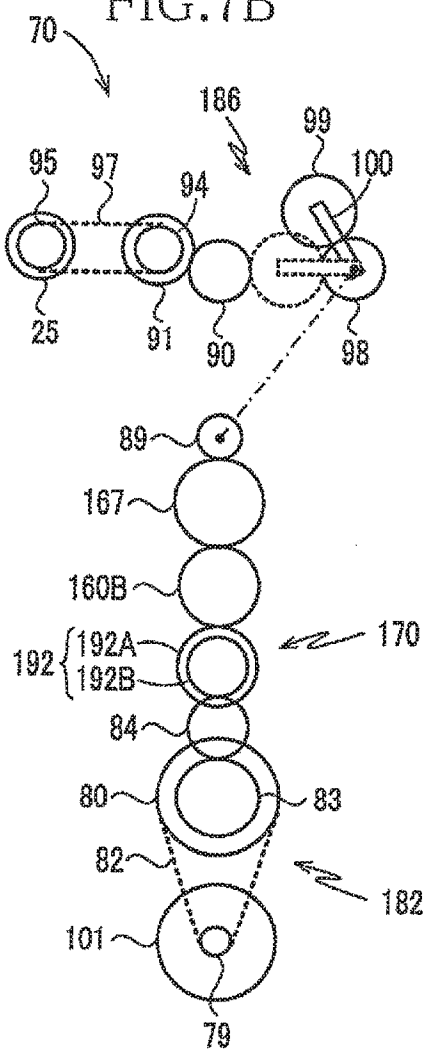
FIG. 7B is a schematic view of the second transmitter, a sixth transmitter, and the switching mechanism.

As illustrated in FIG. 7B, the sixth transmitter 186 includes gears 89-91, pulleys 94, 95, an endless belt 97, a sun gear 98, a pendulum gear 99, and an arm 100.

The gear 89 is in mesh with a receiving gear 167 of the switching mechanism 170. Like the receiving gear 165, the driving force is transmitted to the receiving gear 167 from the supply motor 101 via the second clutch gear 192 and the second slide gear 160B. The sun gear 98 and the gear 89 are rotated together with each other about the same axis. The pendulum gear 99 is in mesh with the sun gear 98 and selectively engaged with and disengaged from a gear 91. The arm 100 is pivotably supported at one end by the sun gear 98 and at the other end supports the pendulum gear 99 such that the pendulum gear 99 can rotate on its axis and revolve around the sun gear 98. The gear 91 and the pulley 94 are rotated together with each other about the same axis. The pulley 95 and the first supply roller 25 are rotated together with each other about the same axis. The belt 97 is looped over the pulleys 94, 95.

When the sun gear 98 is rotated, the pendulum gear 99 revolves around the sun gear 98 while rotating on the axis of the pendulum gear 99. As indicated by the broken line in FIG. 7B, when the reverse driving force produced by the supply motor 101 is transmitted to the sun gear 98, the pendulum gear 99 is separated from the gear 91. As indicated by the solid line in FIG. 7B, when the forward driving force produced by the supply motor 101 is transmitted to the sun gear 98, the pendulum gear 99 comes into meshing engagement with the gear 91. Accordingly, the sixth transmitter 186 does not transmit the reverse driving force produced by the supply motor 101 to the first supply roller 25. On the other hand, the sixth transmitter 186 transmits the forward driving force produced by the supply motor 101 to the first supply roller 25 to rotate the first supply roller 25 forwardly. With the construction as described above, the sixth transmitter 186 transmits the driving force produced by the supply motor 101 from the switching mechanism 170 to the first supply roller 25.

Seventh Transmitter 187

Figure 7C:
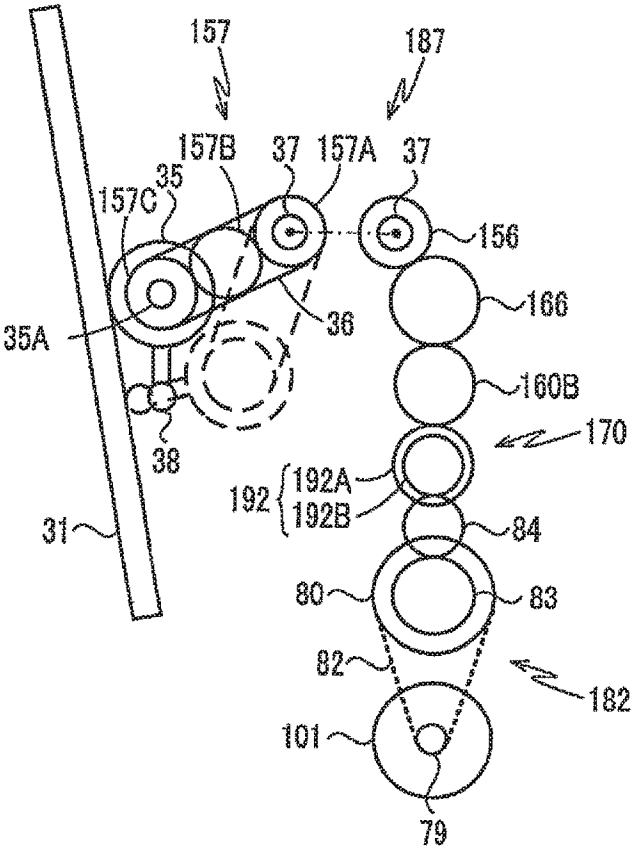
FIG. 7C is a schematic view of the second transmitter, a seventh transmitter, and the switching mechanism.

As illustrated in FIG. 7C, the seventh transmitter 187 includes a gear 156 and a gear train 157. The gear train 157 includes a plurality of gears 157A-157C. The gear 157B is meshed with each of the gears 157A, 157C.

The gear 156 is meshed with a receiving gear 166 of the switching mechanism 170. Like the receiving gear 165, the driving force is transmitted to the receiving gear 166 from the supply motor 101 via the second clutch gear 192 and the second slide gear 160B. The gears 156, 157A are rotated together with the shaft 37. The gear 157C is rotated together with the shaft 35A of the second supply roller 35. It is noted that a torque limiter is disposed between the lifter 38 and the shaft 35A of the second supply roller 35. With this construction, the lifter 38 does not pivot to a position beyond the non-supply position indicated by the broken lines in FIG. 7C in the clockwise direction and does not pivot to a position beyond the supply position indicated by the solid line in FIG. 7C in the counterclockwise direction. In other words, the lifter 38 pivots between the supply position and the non-supply position.

The seventh transmitter 187 having the above-described construction transmits the forward driving force produced by the supply motor 101 to the second supply roller 35 to rotate the second supply roller 35 reversely so as to cause the lifter 38 to pivot toward the non-supply position. Thus, the sheet 12 placed on the MP tray 31 is not supplied to the conveyance path 65 by the forward rotation of the supply motor 101. The seventh transmitter 187 transmits the reverse driving force produced by the supply motor 101 to the second supply roller 35 to rotate the second supply roller 35 forwardly so as to cause the lifter 38 to pivot toward the supply position. Thus, the sheet 12 placed on the MP tray 31 is supplied to the conveyance path 65 by the reverse rotation of the supply motor 101. With the construction as described above, the seventh transmitter 187 transmits the driving force produced by the supply motor 101 from the switching mechanism 170 to the second supply roller 35.

Switching Mechanism 170

The switching mechanism 170 is capable of switching a state of transmission of the driving force produced by each of the conveying motor 102 and the supply motor 101. Specifically, the switching mechanism 170 is capable of switching the state among a first state, a second state, and a third state. In the first state, the driving force produced by the conveying motor 102 is transmitted to the pump 113, and the driving force produced by the supply motor 101 is transmitted to the cam mechanism 112. In the second state, the driving force produced by the conveying motor 102 is not transmitted to the pump 113, and the driving force produced by the supply motor 101 is transmitted to the second supply roller 35 and the lifter 38. In the third state, the driving force produced by the conveying motor 102 is not transmitted to the pump 113, and the driving force produced by the supply motor 101 is transmitted to the first supply roller 25.

The switching mechanism 170 is provided to the right of the platen 42. As illustrated in FIG. 8, the switching mechanism 170 includes a slide gear 160, the roller gear 180, the three receiving gears 165, 166, 167 (as one example of a plurality of transmission gears), a sliding mechanism 150, and a clutch gear 190.

Slide Gear 160, Roller Gear 180, and Receiving Gears 165, 166, 167

As illustrated in FIGS. 8 and 10-12, the slide gear 160 is supported by a support shaft 174 extending in the right and left directions 9. The slide gear 160 is rotatable about the support shaft 174. The slide gear 160 is slidable in the right and left directions 9 coinciding with the axial directions of the support shaft 174, selectively to one of (i) a right position RP illustrated in FIG. 12 as one example of a first position, (ii) a central position MP illustrated in FIG. 11 which is located to the left of the right position RP, and (iii) a left position LP illustrated in FIG. 10 which is located to the left of the central position MP. Each of the central position MP and the left position LP is one example of a second position.

The slide gear 160 includes the first slide gear 160A and the second slide gear 160B. Each of the slide gears 160A, 160B is rotatable about the support shaft 174 and movable in the axial directions of the support shaft 174 (i.e., the right and left directions 9).

The second slide gear 160B is disposed to the left of the first slide gear 160A. The first slide gear 160A and the second slide gear 160B abut on each other.

The second slide gear 160B includes: a gear body 161 having an outer circumferential surface on which teeth are formed; and a protrusion 162 extending rightward from the gear body 161 to the first slide gear 160A. The diameter of the protrusion 162 is less than that of the gear body 161. A distal end of the protrusion 162 and the first slide gear 160A are held in contact with each other by urging forces of a first coil spring 168 and a second coil spring 169 which will be described below. With this construction, teeth of the first slide gear 160A and teeth of the second slide gear 160B (i.e., the gear body 161) are spaced apart from each other in the right and left directions 9.

The first slide gear 160A is in mesh with the roller gear 180 regardless of the position of the slide gear 160. That is, the first slide gear 160A is in mesh with the roller gear 180 regardless of whether the slide gear 160 is located at the right position RP, the central position MP, or the left position LP (see FIGS. 10-12).

The roller gear 180 is fixed to the shaft 60A of the conveying roller 60 at a right end portion of the conveying roller 60. Thus, the roller gear 180 is rotated together with the conveying roller 60. With the construction as described above, the driving force produced by the conveying motor 102 is transmitted to the first slide gear 160A via the roller gear 180.

Depending upon the position of the slide gear 160, the first slide gear 160A is engaged with the first gear 191A of the first clutch gear 191 of the clutch gear 190 or disengaged from the first gear 191A.

The second slide gear 160B is in mesh with the first gear 192A of the second clutch gear 192 of the clutch gear 190 regardless of the position of the slide gear 160. That is, the second slide gear 160B is in mesh with the first gear 192A regardless of whether the slide gear 160 is located at the right position RP, the central position MP, or the left position LP (see FIGS. 10-12).

The second slide gear 160B is selectively meshed with one of the three receiving gears 165, 166, 167, depending upon the position of the slide gear 160. That is, each of the three receiving gears 165, 166, 167 is meshable with the second slide gear 160B.

The receiving gears 165, 166, 167 are arranged in a line so as to be spaced apart from each other in the right and left directions 9. The receiving gear 166 is disposed to the left of the receiving gear 165. The receiving gear 167 is disposed to the left of the receiving gear 166. That is, the receiving gear 165 is disposed on the rightmost position (i.e., on the most upstream position in the left direction) among the three receiving gears 165, 166, 167. The receiving gear 167 is disposed on the leftmost position (i.e., on the most downstream position in the left direction) among the three receiving gears 165, 166, 167.

Each of the distance between the receiving gears 165, 166 in the right and left directions 9 and the distance between the receiving gears 166, 167 in the right and left directions 9 is greater than the length of the gear body 161 of the second slide gear 160B in the axial directions, i.e., the right and left directions 9.

Figure 12:
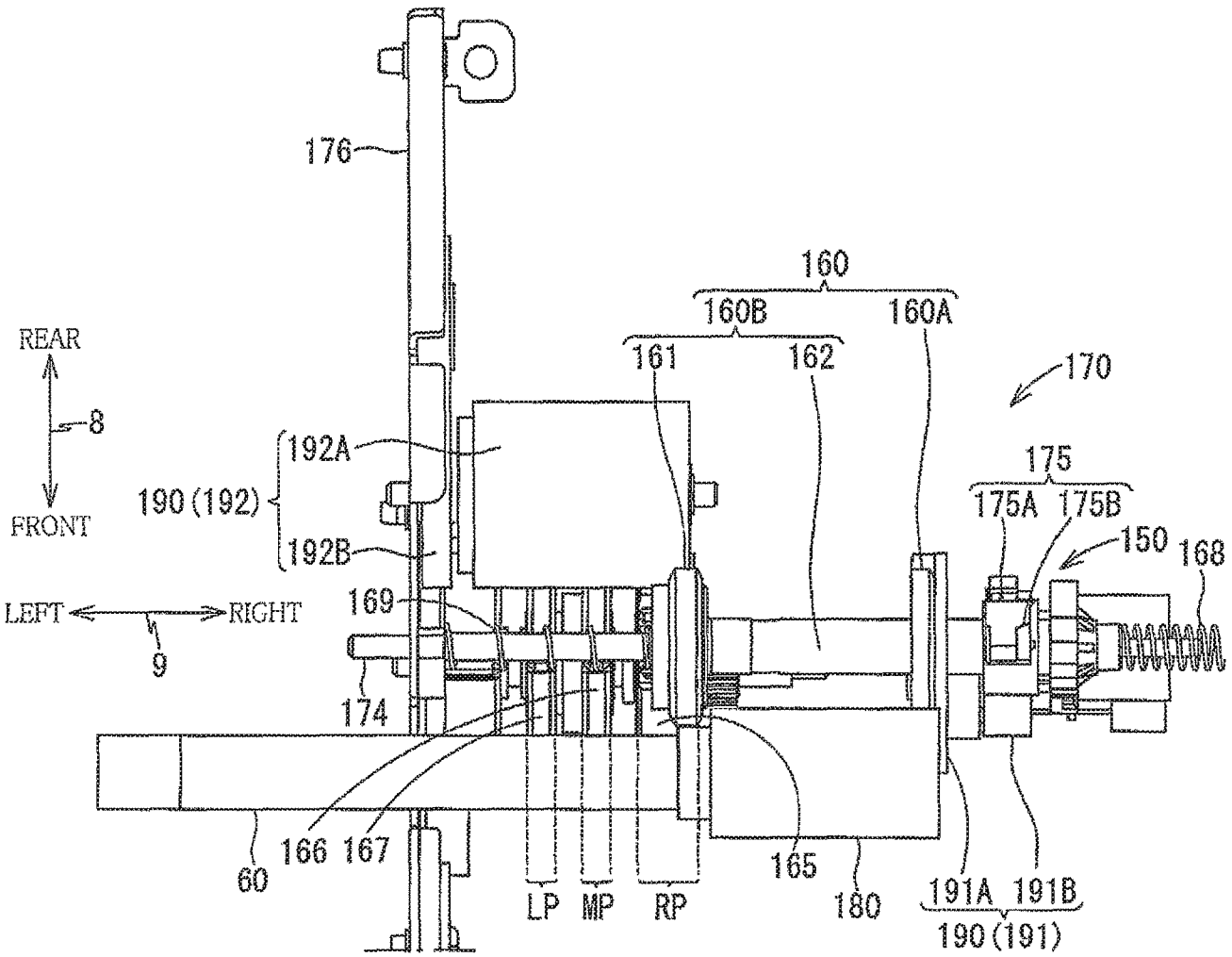
FIG. 12 is a plan view of the switching mechanism and the components near the switching mechanism when the slide gear is located at a right position.

When the slide gear 160 is located at the right position RP, as illustrated in FIG. 12, the first slide gear 160A is in mesh with the roller gear 180 and the first gear 191A of the first clutch gear 191. Thus, the driving force produced by the conveying motor 102 is transmitted to the pump 113 via the first slide gear 160A and the first clutch gear 191 (see FIG. 6).

When the slide gear 160 is located at the right position RP, the second slide gear 160B is in mesh with the first gear 192A of the second clutch gear 192 and the receiving gear 165. Thus, the driving force produced by the supply motor 101 is transmitted via the second slide gear 160B and the receiving gear 165 to the cam mechanism 112 for moving the cap 114 upward and downward (see FIG. 7A). The receiving gear 165 is one example of a first transmission gear.

Figure 10:
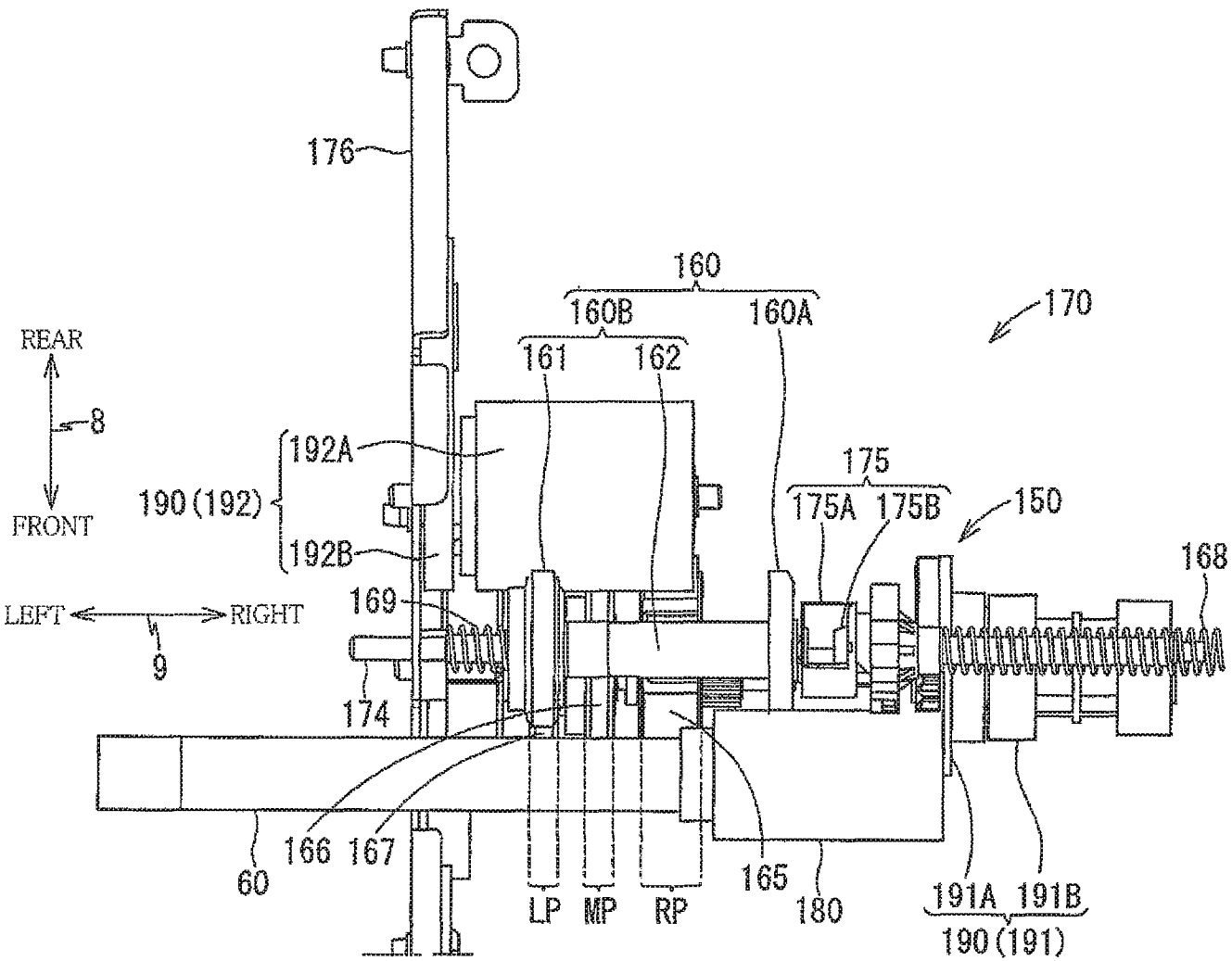
FIG. 10 is a plan view of the switching mechanism and components near the switching mechanism when a slide gear is located at a left position.
Figure 11:
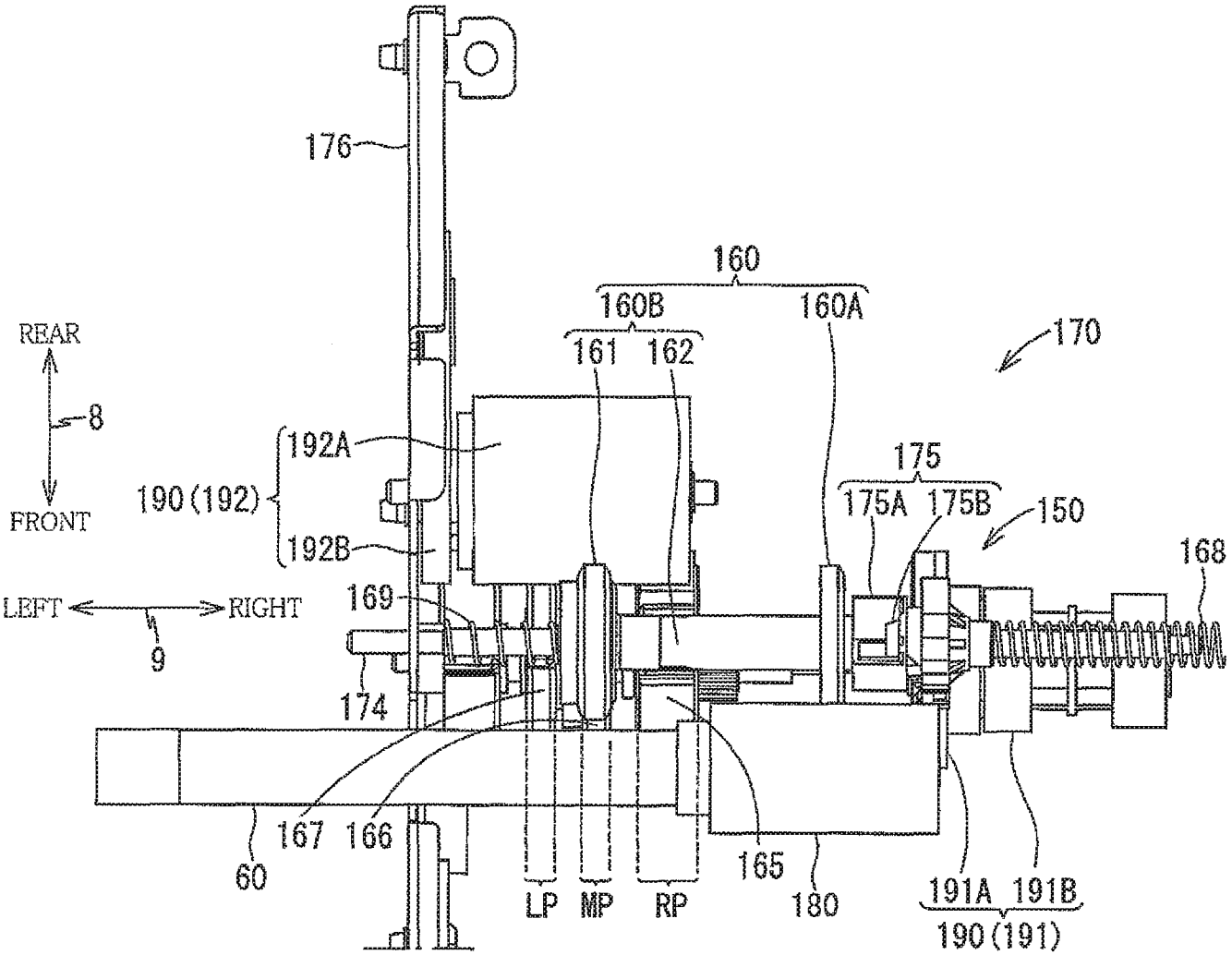
FIG. 11 is a plan view of the switching mechanism and the components near the switching mechanism when the slide gear is located at a central position.

When the slide gear 160 is located at the left position LP or the central position MP, as illustrated in FIGS. 10 and 11, the first slide gear 160A is in mesh with the roller gear 180 but spaced apart from the first gear 191A of the first clutch gear 191. Thus, the driving force produced by the conveying motor 102 is not transmitted to the first clutch gear 191.

When the slide gear 160 is located at the central position MP, as illustrated in FIG. 11, the second slide gear 160B is in mesh with the first gear 192A of the second clutch gear 192 and the receiving gear 166. Thus, the driving force produced by the supply motor 101 is transmitted to the second supply roller 35 and the lifter 38 via the second slide gear 160B and the receiving gear 166 (see FIG. 7C). The receiving gear 166 is one example of a second transmission gear.

When the slide gear 160 is located at the left position LP, as illustrated in FIG. 10, the second slide gear 160B is in mesh with the first gear 192A of the second clutch gear 192 and the receiving gear 167. Thus, the driving force produced by the supply motor 101 is transmitted to the first supply roller 25 via the second slide gear 160B and the receiving gear 167 (see FIG. 7B). Like the receiving gear 166, the receiving gear 167 is one example of the second transmission gear.

While the three receiving gears are provided in the present embodiment, the number of receiving gears is not limited to three. The number of receiving gears may be equal to two or greater than three on condition that the receiving gears at least include a gear for transmitting the driving force to the cam mechanism 112, and a gear for transmitting the driving force to the supply roller, i.e., the first supply roller 25 or the second supply roller 35. For example, two receiving gears are provided in the case where the MFP 10 includes neither the MP tray 31 nor the second supply roller 35. Also, four receiving gears are provided in the case where the MFP 10 includes: two supply trays stacked on each other and to be inserted and removed through the opening 13 in the front and rear directions 8; and two supply rollers provided for the respective supply trays, for example.

Depending upon the number of receiving gears, the slide gear 160 may be movable not only to the above-described positions (namely, the right position RP, the central position MP, and the left position LP) but also to a position or positions different from the above-described positions.

Sliding Mechanism 150

The sliding mechanism 150 moves the slide gear 160 in the right and left directions 9. The sliding mechanism 150 includes: the carriage 23 (see FIG. 2); a lever member 175 (see FIG. 8); the first coil spring 168 (see FIG. 10) as one example of a first urging member; the second coil spring 169 (see FIG. 10) as one example of a second urging member; and a holder 173 (see FIG. 13). It is noted that FIG. 8 does not illustrate the first coil spring 168 and the second coil spring 169.

As illustrated in FIGS. 8 and 10, the lever member 175 is disposed to the right of the first slide gear 160A and held in contact with the first slide gear 160A.

The lever member 175 includes: a main body 175A held in contact with the first slide gear 160A; and a protrusion 175B projecting upward from the main body 175A. The support shaft 174 extends through the main body 175A. The main body 175A is supported by the support shaft 174 so as to be rotatable and movable in the right and left directions 9. The protrusion 175B projects to a position which is located on a moving area of the carriage 23 outside the printing area. The moving area of the carriage 23 is an area, within which the carriage 23 is movable. With this construction, the protrusion 175B can be pushed rightward while contacting the carriage 23 being moved in the right direction as one example of a second direction.

As illustrated in FIG. 10, the first coil spring 168 is disposed to the right of the lever member 175. The support shaft 174 extends through the first coil spring 168. One end of the first coil spring 168 is held in contact with the lever member 175. The other end of the first coil spring 168 is held in contact with, e.g., the frame of the printer 11, not illustrated. This construction allows the first coil spring 168 to urge the lever member 175 in the left direction as one example of a first direction.

As illustrated in FIG. 10, the second coil spring 169 is disposed to the left of the second slide gear 160B. The support shaft 174 extends through the second coil spring 169. One end of the second coil spring 169 is held in contact with the gear body 161 of the second slide gear 160B. The other end of the second coil spring 169 is held in contact with a frame 176 of the printer 11. This construction allows the second coil spring 169 to urge the second slide gear 160B in the right direction.

The urging force of the second coil spring 169 is less than that of the first coil spring 168. Thus, the slide gear 160 (i.e., the first slide gear 160A and the second slide gear 160B) and the lever member 175 are urged leftward.

Figure 13:
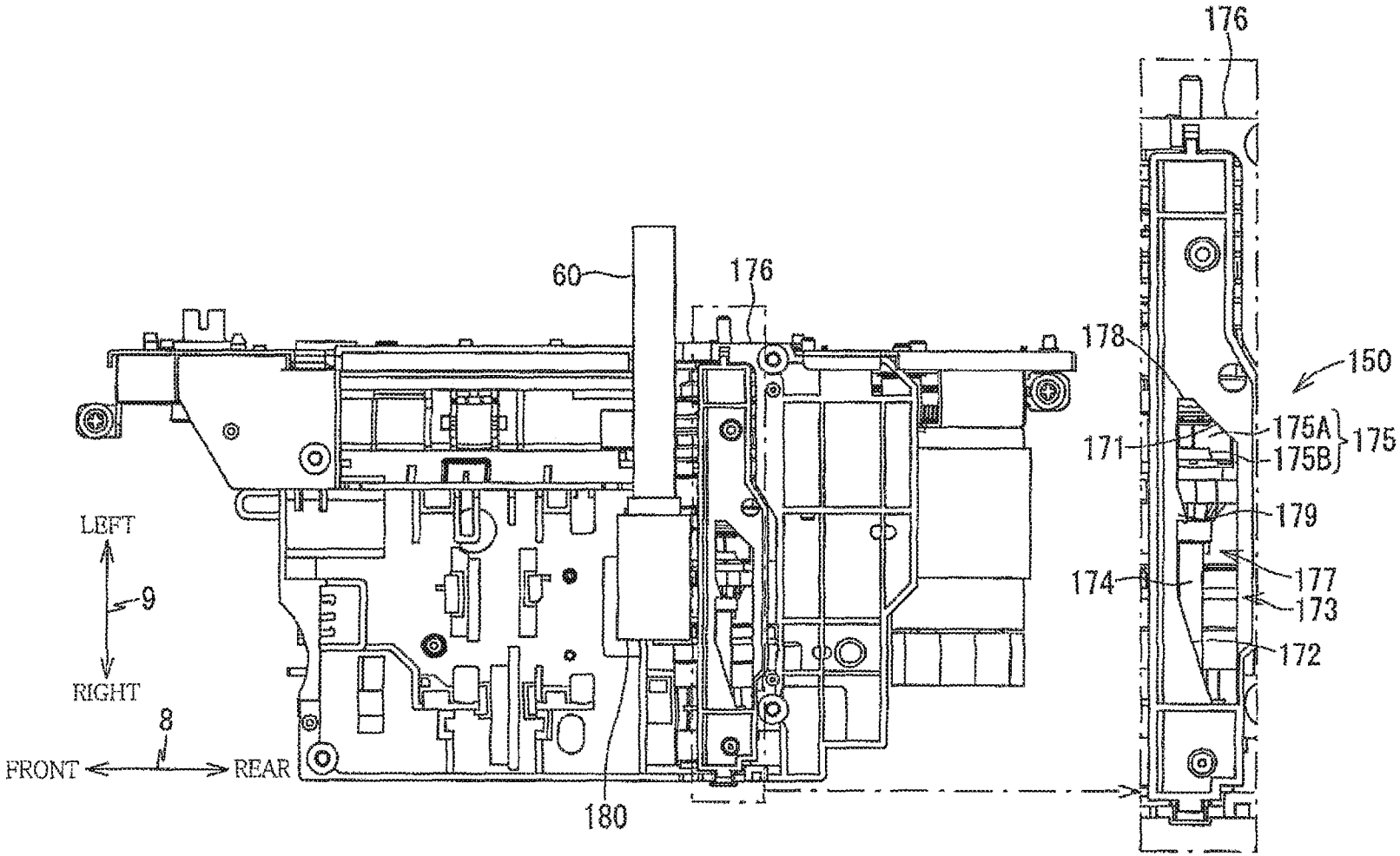
FIG. 13 is a plan view of a holder, a roller gear, and components near the holder and the roller gear.

As illustrated in FIG. 13, the holder 173 is provided on an upper side of the main body 175A of the lever member 175. The holder 173 has an opening 177. The protrusion 175B of the lever member 175 extends upward through the opening 177. An edge of the opening 177 includes: a first stopper 178; a second stopper 179 provided to the right of the first stopper 178; and an inclined surface 172 provided to the right of the second stopper 179.

The first stopper 178 is in contact with the protrusion 175B when the slide gear 160 is located at the left position LP. In this state, the lever member 175 is prevented from moving leftward from the left position LP by the urging force of the first coil spring 168. The first stopper 178 does not prevent rightward movement of the lever member 175.

The second stopper 179 is engaged with the protrusion 175B when the slide gear 160 is located at the central position MP. In this state, the lever member 175 is prevented from moving leftward from the central position MP by the urging force of the first coil spring 168. The second stopper 179 does not prevent rightward movement of the lever member 175.

When the protrusion 175B is pushed by the carriage 23 moving rightward in a state in which the slide gear 160 is kept at the left position LP (i.e., in a state in which the protrusion 175B is engaged with the first stopper 178), the lever member 175 is moved rightward against the urging force of the first coil spring 168. In this movement, the second slide gear 160B urged rightward by the second coil spring 169 is moved rightward with the movement of the lever member 175. The first slide gear 160A is moved rightward by being pushed by the second slide gear 160B being moved. When the protrusion 175B is engaged with the second stopper 179, the slide gear 160 is thereby kept at the central position MP.

When the protrusion 175B is pushed by the carriage 23 moving rightward in a state in which the slide gear 160 is kept at the central position MP (i.e., in a state in which the protrusion 175B is engaged with the second stopper 179), the lever member 175 is moved rightward against the urging force of the first coil spring 168. In this movement, the second slide gear 160B urged rightward by the second coil spring 169 is moved rightward with the movement of the lever member 175. The first slide gear 160A is moved rightward by being pushed by the second slide gear 160B being moved.

In this movement, the protrusion 175B is moved along the inclined surface 172. As a result, the lever member 175 is rotated such that the protrusion 175B is moved rearward.

In a state in which the protrusion 175B is located to the right of the second stopper 179, the carriage 23 is kept in contact with the protrusion 175B, so that the slide gear 160 is kept at the right position RP. In this state, the carriage 23 is located at the home position. That is, the carriage 23 located at the home position is held in contact with the protrusion 175B, whereby the slide gear 160 is kept at the right position RP against the urging force of the first coil spring 168.

When the carriage 23 is moved leftward and disengaged from the protrusion 175B in the state in which the slide gear 160 is kept at the right position RP, the lever member 175 is moved leftward by the urging force of the first coil spring 168. Since the protrusion 175B had been moved rearward as described above, the protrusion 175B is moved to the left of the second stopper 179 without being engaged with the second stopper 179. As a result, the lever member 175 is moved leftward until the protrusion 175B is brought into contact with the first stopper 178. In this movement, the slide gear 160 is pushed by the lever member 175 and moved from the right position RP to the left position LP. That is, when the carriage 23 is moved off the protrusion 175B, the slide gear 160 is moved to the left position LP by the urging force of the first coil spring 168.

It is noted that an inclined surface 171 of the edge of the opening 177 is formed near the first stopper 178, and when the lever member 175 is moved leftward, the protrusion 175B is moved along the inclined surface 171. As a result, the lever member 175 is rotated such that the protrusion 175B is moved frontward.

Clutch Gear 190

As illustrated in FIGS. 8 and 10, the clutch gear 190 includes the first clutch gear 191 and the second clutch gear 192. The first clutch gear 191 includes the first gear 191A and the second gear 191B. The second clutch gear 192 includes the first gear 192A and the second gear 192B.

As illustrated in FIGS. 6 and 12, the first gear 191A of the first clutch gear 191 is meshed with the first slide gear 160A when the slide gear 160 is located at the right position RP. As illustrated in FIG. 6, the second gear 191B of the first clutch gear 191 is meshed with the gear 85 of the fourth transmitter 184.

As illustrated in FIGS. 7, 8, and 10-12, the first gear 192A of the second clutch gear 192 is meshed with the second slide gear 160B. As illustrated in FIGS. 7 and 8, the second gear 192B of the second clutch gear 192 is meshed with the gear 84 of the second transmitter 182.

Figure 14B:
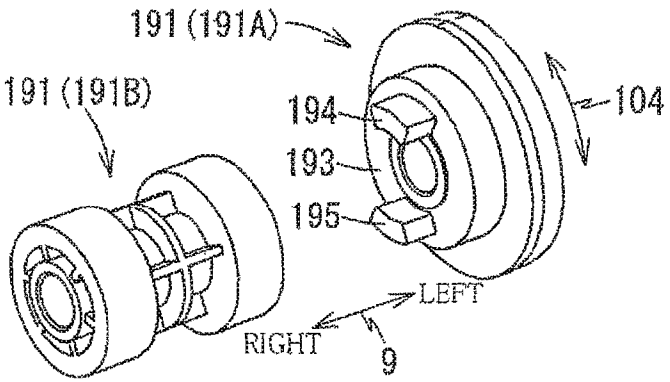
FIGS. 14A and 14B are perspective views of a first clutch gear.
Figure 14D:
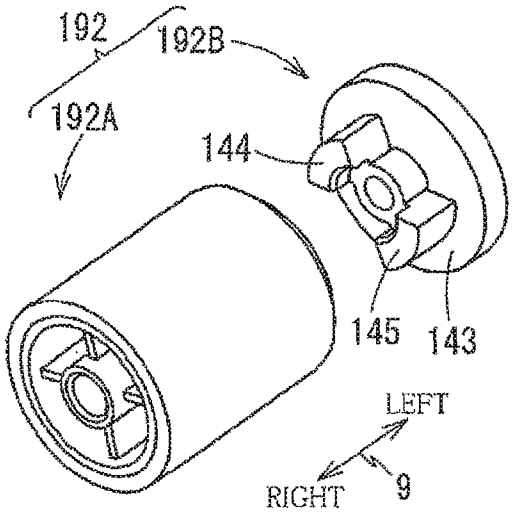
FIGS. 14C and 14D are perspective views of a second clutch gear.
Figure 14A:
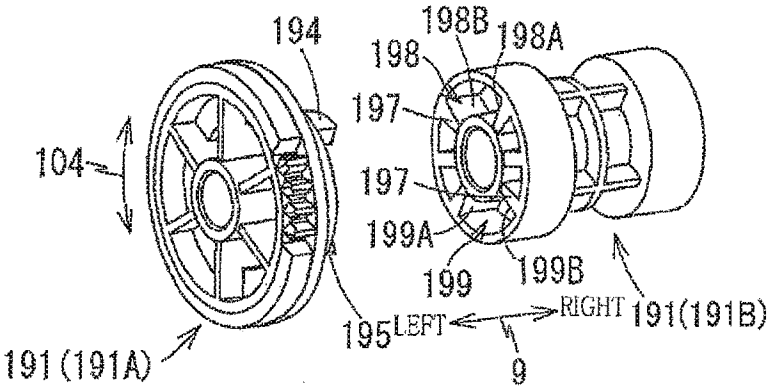

There will be next explained the construction of the first clutch gear 191 with reference to FIGS. 14A and 14B.

The first gear 191A is rotatably supported by a support shaft 151 (see FIG. 8) extending in the right and left directions 9. Likewise, the second gear 191B is rotatably supported by the support shaft 151. That is, the first gear 191A and the second gear 191B are rotated about the same axis.

A right surface 193 of the first gear 191A is provided with two protrusions 194, 195 (each as one example of a contact member) projecting rightward. In other words, the two protrusions 194, 195 protruding toward the second gear 191B are provided on a surface (i.e., the right surface 193) of the first gear 191A which faces the second gear 191B. The protrusions 194, 195 are spaced apart from each other in circumferential directions 104 of the right surface 193. The protrusions 194, 195 have the same length in the circumferential directions 104. Here, as will be described below, one end surface of the protrusion 194 in the circumferential directions 104 is contactable with a side surface 198A of the recess 198. The other end surface of the protrusion 194 in the circumferential directions 104 is contactable with a side surface 198B of the recess 198. That is, the length of the protrusion 194 in the circumferential directions 104 is equal to a distance in the circumferential directions 104 between a contact portion of the protrusion 194 which is to contact the side surface 198A and a contact portion of the protrusion 194 which is to contact the side surface 198B. Likewise, one end surface of the protrusion 195 in the circumferential directions 104 is contactable with a side surface 199A of the recess 199. The other end surface of the protrusion 195 in the circumferential directions 104 is contactable with a side surface 199B of the recess 199. That is, the length of the protrusion 195 in the circumferential directions 104 is equal to a distance in the circumferential directions 104 between a contact portion of the protrusion 195 which is to contact the side surface 199A and a contact portion of the protrusion 195 which is to contact the side surface 199B.

The two recesses 198, 199 are formed in a left surface 197 of the second gear 191B which faces the first gear 191A. The recesses 198, 199 extend in the circumferential directions 104. One end of the recess 198 in the circumferential directions 104 is defined by the side surface 198A as one example of a first surface. The other end of the recess 198 in the circumferential directions 104 is defined by the side surface 198B as one example of a second surface. The side surface 198A and the side surface 198B are formed so as to face each other in the circumferential directions 104. One end of the recess 199 in the circumferential directions 104 is defined by the side surface 199A as another example of the first surface. The other end of the recess 199 in the circumferential directions 104 is defined by the side surface 199B as another example of the second surface. The side surface 199A and the side surface 199B are formed so as to face each other in the circumferential directions 104.

The distance between the side surfaces 198A, 198B in the circumferential directions 104 is equal to the distance between the side surfaces 199A, 199B in the circumferential directions 104. The distance between the side surfaces 198A, 198B in the circumferential directions 104 is greater than the distance between the contact portion of the protrusion 194 which is to contact the side surface 198A and the contact portion of the protrusion 194 which is to contact the side surface 198B in the circumferential directions 104. The distance between the side surfaces 199A, 199B in the circumferential directions 104 is greater than the distance between a contact portion of the protrusion 195 which is to contact the side surface 199A and a contact portion of the protrusion 195 which is to contact the side surface 199B in the circumferential directions 104.

The first gear 191A and the second gear 191B are arranged in a state in which the right surface 193 of the first gear 191A and the left surface 197 of the second gear 191B face each other. In this state, the protrusion 194 is located in the recess 198. That is, the protrusion 194 is located between the side surfaces 198A, 198B of the recess 198. The protrusion 195 is located in the recess 199. That is, the protrusion 195 is located between the side surfaces 199A, 199B of the recess 199. It is noted that the protrusions 194, 195 are inserted in the respective recesses 198, 199, and the protrusions 194, 195 partly contact the respective side surfaces 198A, 199B as described above, and accordingly each of the protrusions 194, 195 is one example of a contact member.

The first clutch gear 191 having the construction described above is rotated as follows.

When the forward driving force is transmitted from the conveying motor 102 to the first gear 191A in a state in which the protrusion 194 is not in contact with the side surface 198A, the first gear 191A is rotated forwardly such that the protrusion 194 is moved toward the side surface 198A. In this rotation, the first gear 191A idles with respect to the second gear 191B. That is, the second gear 191B is not rotated. When the forward rotation of the first gear 191A causes the protrusion 194 to be brought into contact with the side surface 198A and to push the side surface 198A, the second gear 191B is rotated forwardly with the first gear 191A. It is noted that the protrusion 195 may contact and push the side surface 199A instead of or with the protrusion 194 contacting and pushing the side surface 198A.

When the reverse driving force is transmitted from the conveying motor 102 to the first gear 191A in a state in which the protrusion 194 is not in contact with the side surface 198B, the first gear 191A is rotated reversely such that the protrusion 194 is moved toward the side surface 198B. In this rotation, the first gear 191A idles with respect to the second gear 191B. That is, the second gear 191B is not rotated. When the reverse rotation of the first gear 191A causes the protrusion 194 to be brought into contact with the side surface 198B and to push the side surface 198B, the second gear 191B is rotated reversely with the first gear 191A. It is noted that the protrusion 195 may contact and push the side surface 199B instead of or with the protrusion 194 contacting and pushing the side surface 198B.

It is noted that the lengths of the respective protrusions 194, 195 in the circumferential directions 104 may differ from each other on condition that the first gear 191A can idle with respect to the second gear 191B by a particular amount. The distance between the side surfaces 198A, 198B in the circumferential directions 104 may not be equal to the distance between the side surfaces 199A, 199B in the circumferential directions 104.

While the first gear 191A includes the two protrusions, and the second gear 191B has the two recesses in the present embodiment, each of the number of the protrusions and the number of the recesses is not limited to two.

While the first gear 191A includes the protrusions, and the second gear 191B has the recesses to which the respective protrusions are inserted in the present embodiment, the MFP 10 may be configured such that the second gear 191B includes the protrusions, and the first gear 191A has the recesses to which the respective protrusions are inserted.

While the first gear 191A includes the protrusions, and the second gear 191B has the recesses to which the respective protrusions are inserted in the present embodiment, the MFP 10 may have any configuration as long as a protrusion provided on one of the first gear 191A and the second gear 191B is inserted in a space defined between two surfaces which are provided on the other of the first gear 191A and the second gear 191B so as to be spaced apart from each other in the circumferential directions 104.

For example, the MFP 10 may be configured such that each of the first gear 191A and the second gear 191B includes two protrusions spaced apart from each other in the circumferential directions 104, and one of the protrusions of one of the first gear 191A and the second gear 191B is inserted in a space defined between side surfaces of the two protrusions of the other of the first gear 191A and the second gear 191B, which surfaces face each other. In this configuration, the side surfaces facing each other are one example of the first surface and the second surface.

Figure 14C:
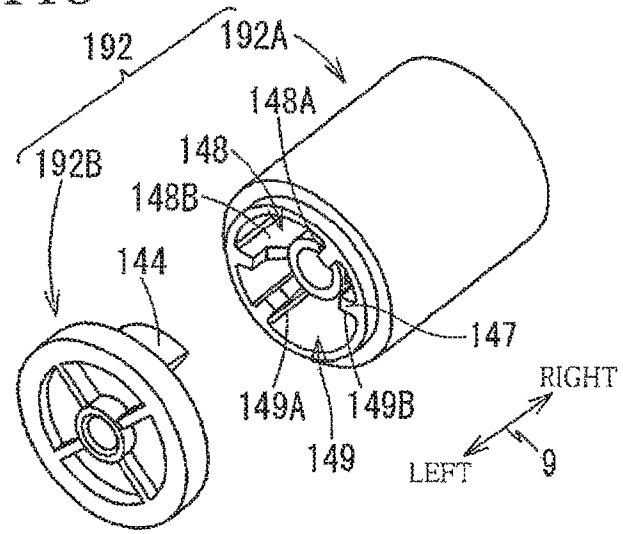

There will be next explained the construction of the second clutch gear 192 with reference to FIGS. 14C and 14D. The second clutch gear 192 is similar in construction to the first clutch gear 191. Thus, there will be principally explained correspondence between elements of the second clutch gear 192 and the elements of the first clutch gear 191.

The first gear 192A is rotatably supported by a support shaft 152 (see FIG. 8) extending in the right and left directions 9. Likewise, the second gear 192B is rotatably supported by the support shaft 152. That is, the first gear 192A and the second gear 192B are rotated about the same axis.

A right surface 143 of the second gear 192B corresponds to the right surface 193 of the first gear 191A. Protrusions 144, 145 (each as another example of the contact member) of the second gear 192B respectively correspond to the protrusions 194, 195 of the first gear 191A.

A left surface 147 of the first gear 192A corresponds to the left surface 197 of the second gear 191B. Through holes 148, 149 extend through the first gear 192A in directions along the support shaft 152, i.e., in the right and left directions 9. These through holes 148, 149 respectively correspond to the recesses 198, 199 formed in the left surface 197 of the second gear 191B. It is noted that the through holes 148, 149 of the first gear 192A may be replaced with recesses formed in the left surface 147. Also, the recesses 198, 199 of the second gear 191B may be replaced with through holes extending in the right and left directions 9. Side surfaces 148A, 148B of the through hole 148 respectively correspond to the side surfaces 198A, 198B of the recess 198. Side surfaces 149A, 149B of the through hole 149 respectively correspond to the side surfaces 199A, 199B of the recess 199. Each of the side surfaces 148A, 149A is another example of the first surface, and each of the side surfaces 148B, 149B is another example of the second surface.

The second gear 192B and the first gear 192A are arranged in a state in which the right surface 143 of the second gear 192B and the left surface 147 of the first gear 192A face each other. In this state, the protrusion 144 is located in the through hole 148. That is, the protrusion 144 is located between the side surfaces 148A, 148B of the through hole 148. The protrusion 145 is located in the through hole 149. That is, the protrusion 145 is located between the side surfaces 149A, 149B of the through hole 149.

The second clutch gear 192 having the construction described above is rotated as follows.

When the forward driving force is transmitted from the conveying motor 102 to the second gear 192B in a state in which the protrusion 144 is not in contact with the side surface 148A, the second gear 192B is rotated forwardly such that the protrusion 144 is moved toward the side surface 148A. In this rotation, the second gear 192B idles with respect to the first gear 192A. That is, the first gear 192A is not rotated. When the forward rotation of the second gear 192B causes the protrusion 144 to be brought into contact with the side surface 148A and to push the side surface 148A, the first gear 192A is rotated forwardly with the second gear 192B. It is noted that the protrusion 145 may contact and push the side surface 149A instead of or with the protrusion 144 contacting and pushing the side surface 148A.

When the reverse driving force is transmitted from the conveying motor 102 to the second gear 192B in a state in which the protrusion 144 is not in contact with the side surface 148B, the second gear 192B is rotated reversely such that the protrusion 144 is moved toward the side surface 148B. In this rotation, the second gear 192B idles with respect to the first gear 192A. That is, the first gear 192A is not rotated. When the reverse rotation of the second gear 192B causes the protrusion 144 to be brought into contact with the side surface 148B and to push the side surface 148B, the first gear 192A is rotated reversely with the second gear 192B. It is noted that the protrusion 145 may contact and push the side surface 149B instead of or with the protrusion 144 contacting and pushing the side surface 148B.

Controller 130

As illustrated in FIG. 4, the controller 130 includes a CPU 131, a ROM 132, a RAM 133, an the EEPROM 134, and an ASIC 135 which are connected to each other by an internal bus 137. The ROM 132 stores programs and information to be used by the CPU 131 to control various operations. The RAM 133 is used as a working area for data processing or as a storage area for temporarily storing data, signals, and the like to be used by the CPU 131 to execute the above-described programs. The EEPROM 134 stores settings, flags, and the like to be kept also after the MFP 10 is turned off.

The devices including the supply motor 101, the conveying motor 102, and the carriage motor 103 are connected to the ASIC 135. The ASIC 135 creates drive signals for rotating the motors to control the motors based on the created signals. Each of the motors is rotated forwardly or reversely based on the drive signals created by the ASIC 135. For example, the controller 130 controls the supply motor 101 to rotate each of the supply rollers 25, 35 and drive the cam mechanism 112. The controller 130 controls the conveying motor 102 to rotate each of the rollers 60, 62 and drive the pump 113. The controller 130 controls the carriage motor 103 to reciprocate the carriage 23. The controller 130 controls the recording head 39 to eject the ink from the nozzles 40. That is, the controller 130 controls the motors 101, 102, 103 and the sliding mechanism 150.

Processings Executed During Movement of Slide Gear 160 in First Embodiment

Figure 15:
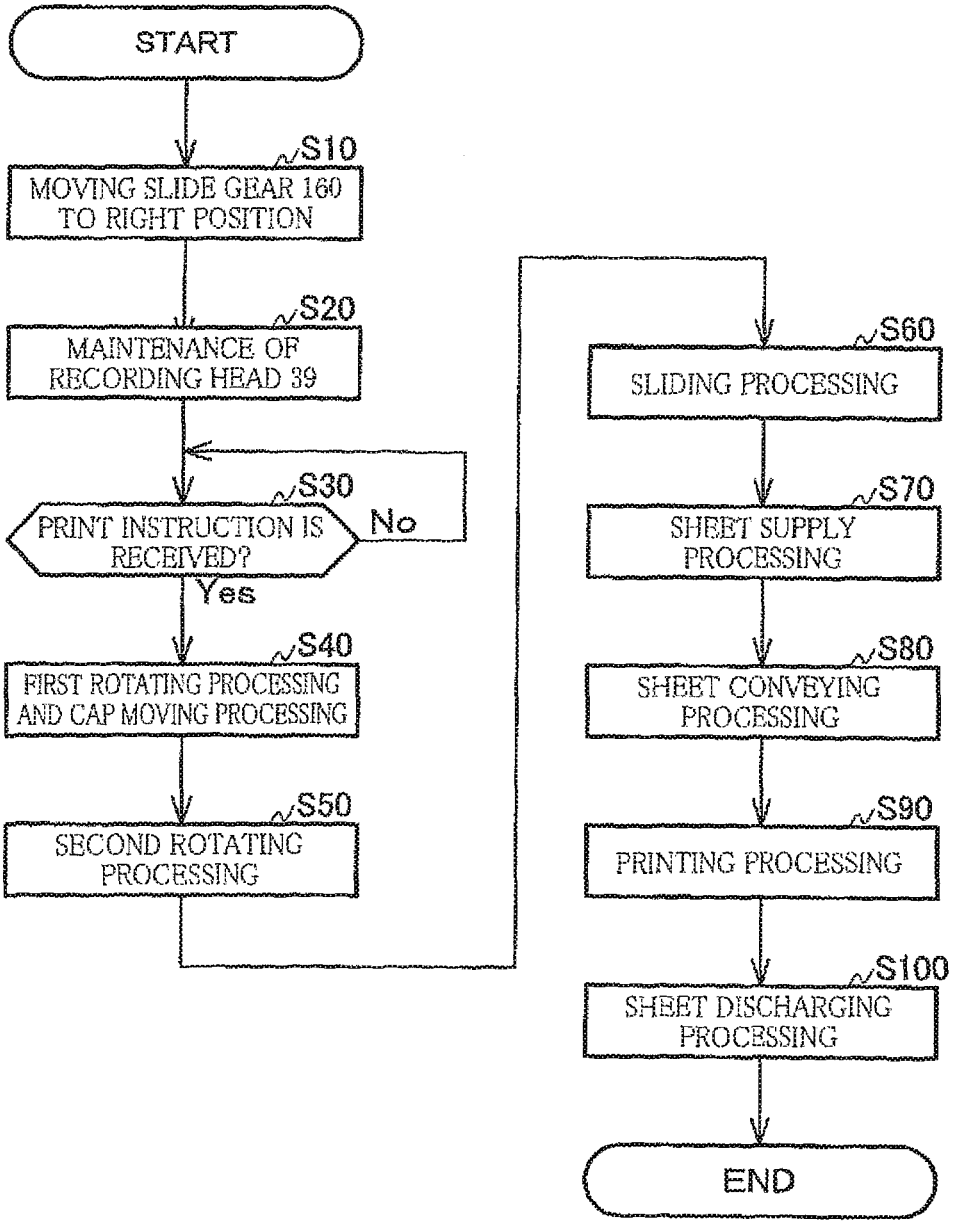
FIG. 15 is a flow chart illustrating processings to be executed when the slide gear is moved in right and left directions in the first embodiment.

There will be next explained, with reference to FIG. 15, a flow of processings to be executed when the slide gear 160 is moved in the right and left directions 9 in the state in which the slide gear 160 is in mesh with the first gears 191A, 192A. The CPU 131 of the controller 130 executes the processings. It is noted that the processings may be executed by the CPU 131 reading the programs stored in the ROM 132 and may be executed by hardware circuits mounted on the controller 130.

In the case where maintenance of the recording head 39 is performed, this flow begins with S10 at which the slide gear 160 is moved to the right position RP and engaged with the first gears 191A, 192A as illustrated in FIG. 12. Specifically, the controller 130 drives the carriage motor 103 to move the carriage 23 rightward. The carriage 23 being moved pushes the protrusion 175B of the lever member 175. As a result, the slide gear 160 is moved to the right position RP by the urging force of the second coil spring 169. It is noted that, as described above, the carriage 23 is located at the home position when the slide gear 160 is located at the right position RP.

The maintenance of the recording head 39 is performed at S20 in this state in the following manner. The controller 130 initially rotates the supply motor 101 reversely. As a result, as illustrated in FIG. 7A, the reverse driving force produced by the supply motor 101 is transmitted to the cam mechanism 112 via the second transmitter 182, the switching mechanism 170 (specifically, the second clutch gear 192, the second slide gear 160B, and the receiving gear 165), and the fifth transmitter 185. As a result, the movable member 111 spaced apart from the lower surface of the recording head 39 is moved upward and brought into contact with the lower surface of the recording head 39. In this movement, the cap 114 is moved from the separated position to the covering position to cover the nozzles 40. It is noted that the protrusion 144 of the second gear 192B and the side surface 148B of the first gear 192A are held in contact with each other as a result of the rotation of the second clutch gear 192 which is performed by the reverse rotation of the supply motor 101.

The controller 130 then rotates the conveying motor 102 forwardly. As a result, as illustrated in FIG. 6, the forward driving force produced by the conveying motor 102 is transmitted to the pump 113 via the first transmitter 181, the switching mechanism 170 (specifically, the roller gear 180, the first slide gear 160A, and the first clutch gear 191), and the fourth transmitter 184. The transmitted reverse driving force drives the pump 113 to suck the ink from the nozzles 40. It is noted that the protrusion 194 of the first gear 191A and the side surface 198B of the second gear 191B are held in contact with each other as a result of the rotation of the first clutch gear 191 which is performed by the reverse rotation of the conveying motor 102.

Upon completion of the maintenance of the recording head 39, the controller 130 at S30 determines whether a print instruction for printing an image on the sheet 12 is received. An operation panel 17 is provided on an upper portion of the front surface of the MFP 10 (see FIG. 1). The print instruction is output from the operation panel 17 when a user operates the operation panel 17 or from an external device, not illustrated, such as a personal computer, connected to the MFP 10 by cables or wirelessly. When the controller 130 receives the print instruction from the operation panel 17 or the external device (S30: Yes), the controller 130 at S40 executes a first rotating processing (as one example of a rotating processing) and a cap moving processing in parallel.

Figure 17:
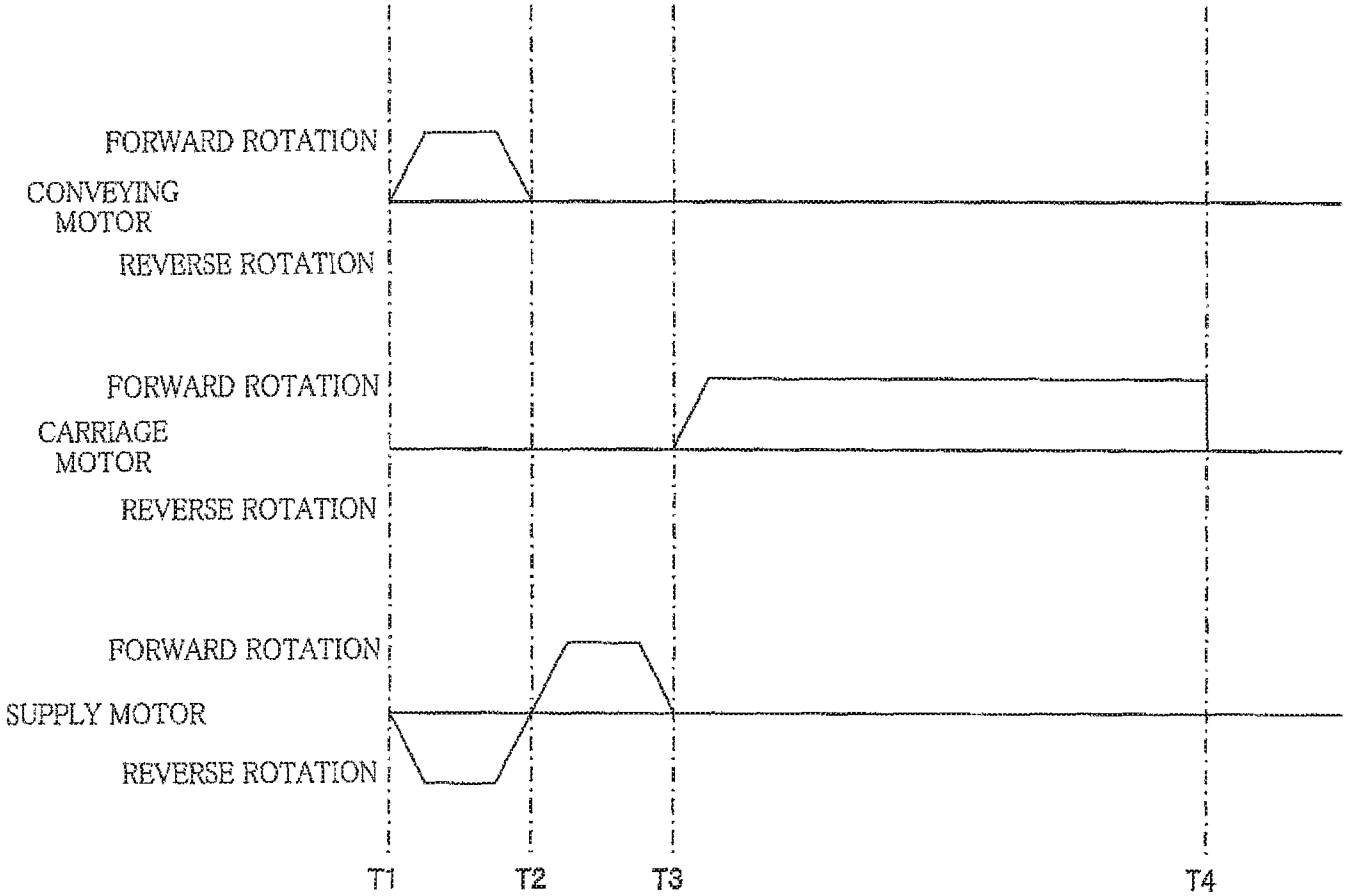
FIG. 17 is a time chart illustrating operations of motors when the slide gear is moved in the right and left directions.

Specifically, as illustrated in FIG. 17, the controller 130 rotates the conveying motor 102 forwardly and rotates the supply motor 101 reversely (T1-T2 in FIG. 17). The first rotating processing is executed by the forward rotation of the conveying motor 102, and the cap moving processing is executed by the reverse rotation of the supply motor 101. It is noted that FIG. 17 indicates that the forward rotation of the conveying motor 102 and the reverse rotation of the supply motor 101 start at the same timing and end at the same timing, but the forward rotation of the conveying motor 102 and the reverse rotation of the supply motor 101 may start at different timings and may end at different timings.

The first rotating processing and the cap moving processing will be explained below.

The rotating processing is a processing for rotating the clutch gear 190. The first rotating processing is a processing for rotating the first clutch gear 191 of the clutch gear 190.

The controller 130 rotates the conveying motor 102 forwardly such that the direction of this rotation is reverse to that of the rotation of the conveying motor 102 at S20 (T1-T2 in FIG. 17). As illustrated in FIG. 6, the forward driving force produced by the conveying motor 102 is transmitted to the first gear 191A of the first clutch gear 191 via the first transmitter 181, the roller gear 180, and the first slide gear 160A. Upon receiving the forward driving force, the first gear 191A is rotated to move the protrusion 194 away from the side surface 198B of the second gear 191B and toward the side surface 198A. An amount of this rotation of the first gear 191A is less than the particular amount. Here, the particular amount is obtained by subtracting the length of the protrusion 194 of the first gear 191A in the circumferential directions 104 from the distance between the side surfaces 198A, 198B of the second gear 191B in the circumferential directions 104. Thus, the first gear 191A is rotated in the first rotating processing so as to establish a state in which the protrusion 194 is not in contact with the side surfaces 198A, 198B of the second gear 191B. As a result, the first gear 191A and the second gear 191B are allowed to idle with respect to each other.

It is noted that the amount of rotation of the first gear 191A can be detected by a well-known device such as a rotary encoder. The rotary encoder includes an encoder disc and an optical sensor. The encoder disc is rotated with a component such as a roller or a gear which can transfer the driving force with the first gear 191A or the first gear 191A. The optical sensor creates pulse signals by reading the encoder disc being rotated and transmits the pulse signals to the controller 130. The controller 130 detects the amount of rotation of the first gear 191A based on this pulse signals.

The controller 130 can detect a position of the first gear 191A relative to the second gear 191B as follows. At the start of the first rotating processing, the protrusion 194 and the side surface 198B are held in contact with each other. The controller 130 can detect the distance between the protrusion 194 and the side surface 198B in the circumferential directions 104 by detecting an amount of rotation of the first gear 191A from the start of the first rotating processing. That is, the controller 130 can detect the position of the first gear 191A relative to the second gear 191B.

The cap moving processing is a processing for lowering the movable member 111 being in contact with the lower surface of the recording head 39 at S20. The controller 130 rotates the supply motor 101 reversely (T1-T2 in FIG. 17). As in the processing at S20, the driving force produced by the supply motor 101 is transmitted to the cam mechanism 112. As a result, the movable member 111 is moved downward away from the lower surface of the recording head 39. In this movement, the cap 114 is moved from the covering position to the separated position.

After the completion of the cap moving processing, the controller 130 at S50 executes a second rotating processing as another example of the rotating processing. The second rotating processing is a processing for rotating the second clutch gear 192 of the clutch gear 190.

The controller 130 rotates the supply motor 101 forwardly such that the direction of this rotation is reverse to that of the rotation of the supply motor 101 at S20 (T2-T3 in FIG. 17). As illustrated in FIG. 7, the forward driving force produced by the supply motor 101 is transmitted to the second gear 192B of the second clutch gear 192 via the second transmitter 182. Upon receiving the forward driving force, the second gear 192B is rotated to move the protrusion 144 away from the side surface 148B of the first gear 192A and toward the side surface 148A. As in the first rotating processing, an amount of this rotation of the second gear 192B is less than the particular amount. Thus, the second gear 192B is rotated in the second rotating processing so as to establish a state in which the protrusion 144 is not in contact with the side surfaces 148A, 148B of the first gear 192A. As a result, the first gear 192A and the second gear 192B are allowed to idle with respect to each other.

It is noted that the amount of rotation of the second gear 192B and the position of the second gear 192B relative to the first gear 192A can be detected by a well-known means as in the case of the first clutch gear 191.

After the completion of the second rotating processing, the controller 130 at S60 executes a sliding processing.

The sliding processing is a processing for moving the slide gear 160 leftward from the right position RP. The controller 130 drives the carriage motor 103 to move the carriage 23 from the home position toward the printing area (in T3-T4 in FIG. 17). That is, the carriage 23 is moved leftward from the home position. As a result, the slide gear 160 is moved toward the left position LP by the urging force of the first coil spring 168. Here, the first gear 191A is allowed to idle with respect to the second gear 191B by the first rotating processing, and the first gear 192A is allowed to idle with respect to the second gear 192B by the second rotating processing. This state allows smooth movement of the slide gear 160.

After the sliding processing (S60), the controller 130 at S70 executes a sheet supply processing. The controller 130 rotates the supply motor 101 reversely in the sheet supply processing. As a result, the first supply roller 25 is rotated forwardly to supply the sheet 12 from the supply tray 20 to the conveyance path 65.

As described above, the first rotating processing (S40) and the second rotating processing (S50) are executed between the print instruction (S30) and the sheet supply processing (S70). Thus, the slide gear 160 can be smoothly moved from the right position RP to the left position LP in the sliding processing (S60). Then, in the sheet supply processing (S70), the reverse driving force produced by the supply motor 101 is transmitted to the first supply roller 25 via the slide gear 160 (i.e., the second slide gear 160B) located at the left position LP. That is, since the slide gear 160 can be smoothly moved to the left position LP, it is possible to reduce a length of time between the print instruction (S30) and the sheet supply processing (S70).

The sheet 12 supplied to the conveyance path 65 is brought into contact with the conveying roller unit 54. The conveying motor 102 is rotated reversely or at rest at the point in time when the sheet 12 is brought into contact with the conveying roller unit 54. Accordingly, skew of the sheet 12 is corrected by the contact of the sheet 12 with the conveying roller unit 54.

At S80, the controller 130 thereafter executes a sheet conveying processing. In the sheet conveying processing, the controller 130 causes forward rotation of the conveying motor 102 which is rotated reversely or at rest. When the conveying roller 60 is rotated forwardly, the sheet 12 is nipped and conveyed by the conveying roller unit 54 in the conveying direction 16 toward the position just under the recording device 24.

At S90, the controller 130 executes a printing processing. In this printing processing, the controller 130 causes a recording operation and a conveyance operation alternately. In the recording operation, the controller 130 controls the recording head 39 to eject the ink droplets from the nozzles 40 while reciprocating the carriage 23. In the conveyance operation, the controller 130 rotates the conveying motor 102 forwardly by a certain amount to convey the sheet 12 by an amount corresponding to a line feed. As a result of the printing processing, an image is recorded on the sheet 12.

The length of time between the print instruction (S30) and the start of the sheet supply processing (S70) can be reduced as described above, resulting in reduction in length of time between the print instruction (S30) and the start of the printing processing (S90) for a first sheet 12.

After the completion of the printing on the sheet 12, the controller 130 at S100 executes a sheet discharging processing. In the sheet discharging processing, the controller 130 rotates the conveying motor 102 forwardly. The output roller 62 is rotated forwardly by the forward rotation of the conveying motor 102 to convey the sheet 12 in the conveying direction 16, with the sheet 12 nipped by the output roller unit 55. The conveyed sheet 12 is discharged onto the output tray 21.

To record an image on the sheet 12 supported on the MP tray 31, the controller 130 moves the carriage 23 rightward between S60 and S70 to move the slide gear 160 from the left position LP to the central position MP. The second rotating processing may be executed in the movement. In the sheet supply processing (S70), the supply motor 101 is rotated reversely, so that the lifter 38 pivots toward the supply position, and the second supply roller 35 is rotated forwardly. As a result, the sheet 12 supported on the MP tray 31 is supplied to the conveyance path 65.

Effects in First Embodiment

In the first embodiment, when the rotating processing is executed by the controller 130, the protrusion 194 is not in contact with any of the side surfaces 198A, 198B. Thus, the first gear 191A of the first clutch gear 191 is rotatable by an amount of clearance between the protrusion 194 and each of the side surfaces 198A, 198B. Also, the protrusion 144 is not in contact with any of the side surfaces 148A, 148B. Thus, the first gear 192A of the second clutch gear 192 is rotatable by an amount of clearance between the protrusion 144 and each of the side surfaces 148A, 148B. Accordingly, it is possible to smoothly perform (i) the operation in which the slide gear 160 is slid and engaged with the first gear 191A, (ii) the operation in which the slide gear 160 being in mesh with the first gear 191A is slid and disengaged from the first gear 191A, and (iii) the operation in which the slide gear 160 is slid in the state in which the slide gear 160 is in mesh with the first gear 192A.

In the first embodiment, when the carriage 23 is moved from the home position to the printing area in the sliding processing, the first slide gear 160A is slid from the right position RP to the left position LP by the urging force of the first coil spring 168. As a result, the first slide gear 160A is disengaged from the first gear 191A of the first clutch gear 191. At this time, the first gear 191A is rotatable by the rotating processing executed by the controller 130. This configuration enables smooth separation of the first slide gear 160A from the first gear 191A.

In the first embodiment, when the carriage 23 is moved from the home position to the printing area in the sliding processing, the second slide gear 160B is slid from the first position to the second position by being pushed by the first slide gear 160A slid by the urging force of the first coil spring 168. As a result, the state of the second slide gear 160B is switched from the state in which the second slide gear 160B is in mesh with the receiving gear 165 to the state in which the second slide gear 160B is in mesh with the receiving gear 167. In this switch, the first gear 192A of the second clutch gear 192 is rotatable by the rotating processing executed by the controller 130. Accordingly, the second slide gear 160B can be easily slid from the position at which the second slide gear 160B is in mesh with the receiving gear 165 to the position at which the second slide gear 160B is in mesh with the receiving gear 167.

In the first embodiment, the controller 130 at S40 executes the cap moving processing for moving the cap 114 and the first rotating processing for rotating the first clutch gear 191 in parallel. Accordingly, the sliding processing (S50) can be executed earlier.

In the first embodiment, the distance between each adjacent two of the receiving gears 165, 166, 167 in the right and left directions 9 is longer than the length of the gear body 161 of the second slide gear 160B in the right and left directions 9. This construction prevents the second slide gear 160B from being meshed with a plurality of receiving gears at the same time.

Second Embodiment

Figure 18:
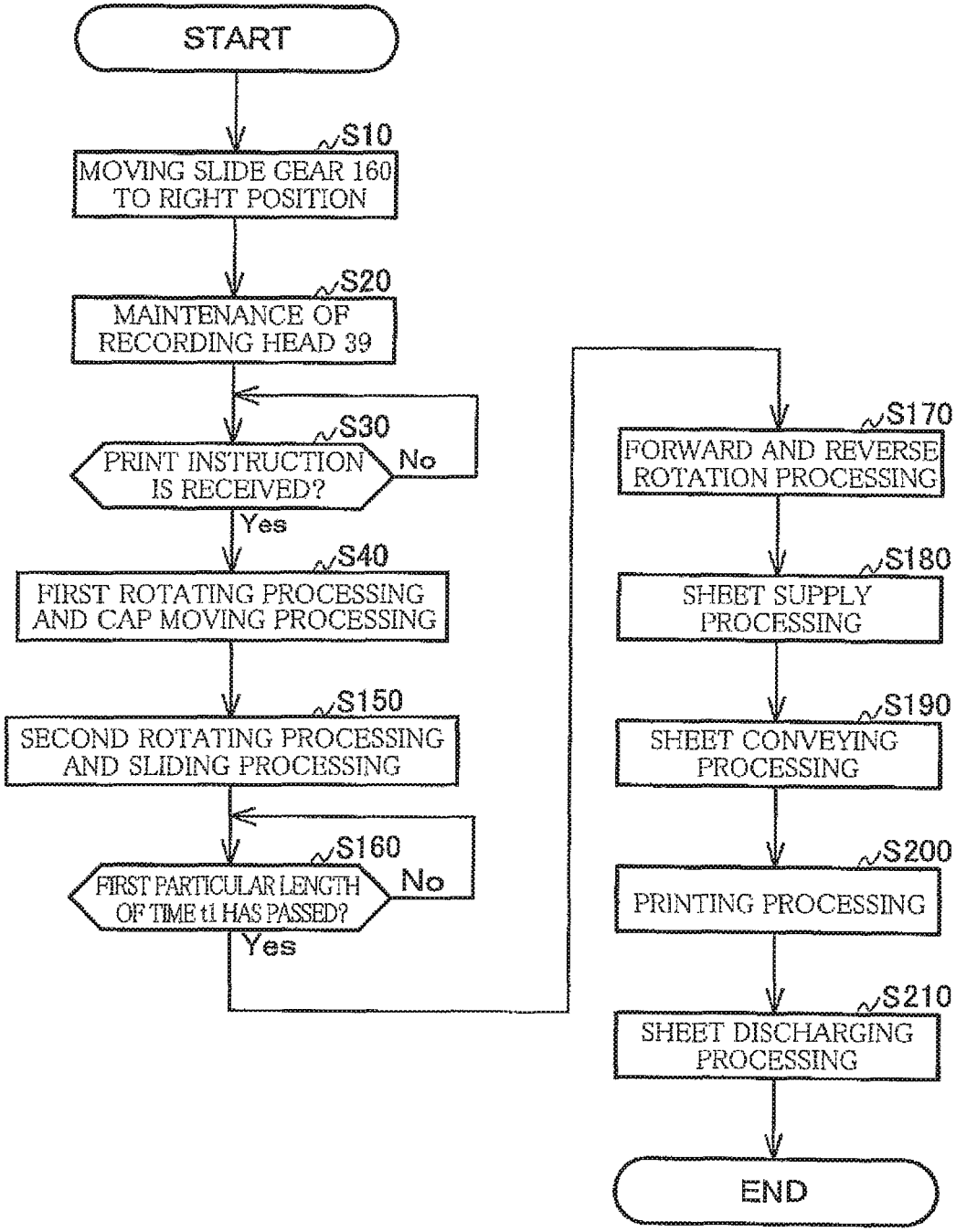
FIG. 18 is a flow chart illustrating processings to be executed when the slide gear is moved in right and left directions in a second embodiment.
Figure 19:
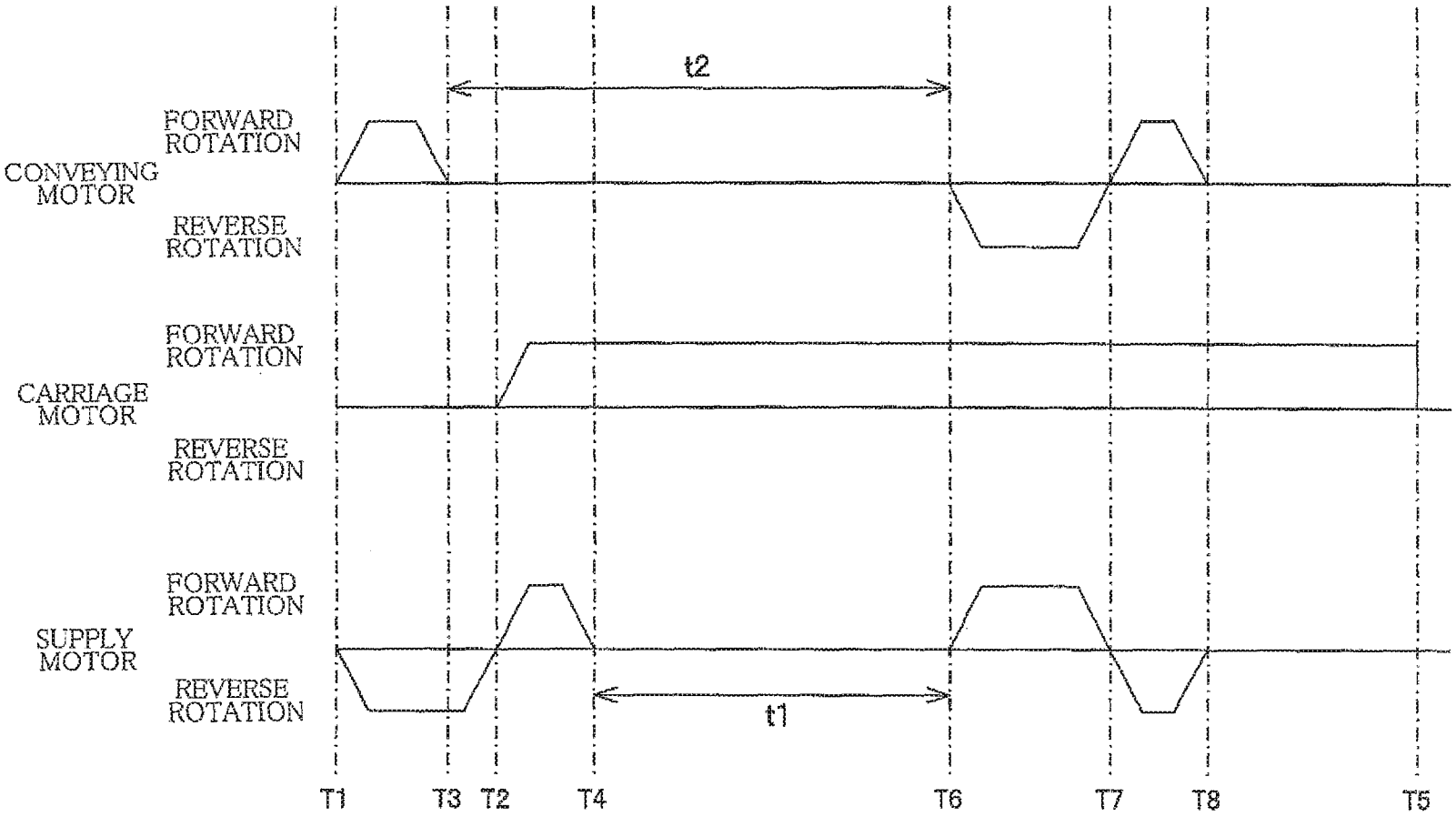
FIG. 19 is a time chart illustrating operations of motors when the slide gear is moved in the right and left directions in the second embodiment.

There will be next explained a second embodiment with reference to FIGS. 18 and 19. It is noted that the same reference numerals as used in the first embodiment are used to designate the corresponding elements and processings of the second embodiment, and an explanation of which is dispensed with.

Processings Executed During Movement of Slide Gear 160 in Second Embodiment

There will be next explained, with reference to the flow chart in FIG. 18 and the time chart in FIG. 19, processings to be executed in the second embodiment when the slide gear 160 is moved in the right and left directions 9 in the state in which the slide gear 160 is in mesh with the first gears 191A, 192A. It is noted that the same processing as executed at S10 in the first embodiment is executed in this second embodiment.

The maintenance of the recording head 39 is performed at S20. The controller 130 initially rotates the supply motor 101 reversely. As a result, as illustrated in FIG. 7A, the reverse driving force produced by the supply motor 101 is transmitted to the cam mechanism 112 via the second transmitter 182, the switching mechanism 170 (specifically, the second clutch gear 192, the second slide gear 160B, and the receiving gear 165), and the fifth transmitter 185. As a result, the movable member 111 spaced apart from the lower surface of the recording head 39 is moved upward and brought into contact with the lower surface of the recording head 39. In this movement, the cap 114 is moved from the separated position to the covering position to cover the nozzles 40. It is noted that the protrusion 144 of the second gear 192B and the side surface 148B of the first gear 192A are held in contact with each other as a result of the rotation of the second clutch gear 192 which is performed by the reverse rotation of the supply motor 101.

The controller 130 then rotates the conveying motor 102 forwardly. As a result, as illustrated in FIG. 6, the forward driving force produced by the conveying motor 102 is transmitted to the pump 113 via the first transmitter 181, the switching mechanism 170 (specifically, the roller gear 180, the first slide gear 160A, and the first clutch gear 191), and the fourth transmitter 184. The transmitted reverse driving force drives the pump 113 to suck the ink from the nozzles 40. The controller 130 then drives the conveying motor 102 reversely. With this driving, the reverse driving force produced by the conveying motor 102 is transmitted to the pump 113 as in the case where the controller 130 then drives the conveying motor 102 forwardly. As a result, the pump 113 communicates with air. It is noted that the protrusion 194 of the first gear 191A and the side surface 198B of the second gear 191B are held in contact with each other as a result of the rotation of the first clutch gear 191 which is performed by the reverse rotation of the conveying motor 102.

Upon completion of the maintenance of the recording head 39, the controller 130 at S30 determines whether a print instruction for printing an image on the sheet 12 is received. An operation panel 17 is provided on an upper portion of the front surface of the MFP 10 (see FIG. 1). The print instruction is output from the operation panel 17 when a user operates the operation panel 17 or from an external device, not illustrated, such as a personal computer, connected to the MFP 10 by cables or wirelessly. When the controller 130 receives the print instruction from the operation panel 17 or the external device (S30: Yes), the controller 130 at S40 executes the first rotating processing and the cap moving processing in parallel. It is noted that the controller 130 executes the first rotating processing at S40 and the second rotating processing at S150, which will be described below, as the rotating processing.

Specifically, as illustrated in FIG. 19, the controller 130 rotates the conveying motor 102 forwardly (T1-T3 in FIG. 19) and rotates the supply motor 101 reversely (T1-T2 in FIG. 19). The first rotating processing is executed by the forward rotation of the conveying motor 102, and the cap moving processing is executed by the reverse rotation of the supply motor 101.

In the present embodiment, the forward rotation of the conveying motor 102 and the reverse rotation of the supply motor 101 are started at the same time (at T1 in FIG. 19) but may not be started at the same time.

In the present embodiment, the forward rotation of the conveying motor 102 is finished at the timing (at T3 in FIG. 19) before the timing when the reverse rotation of the supply motor 101 is finished (at T2 in FIG. 19). This is for preventing the forward rotation of the conveying motor 102 from affecting the forward rotation of the carriage motor 103 in the sliding processing which will be described below (noted that the forward rotation of the carriage motor 103 is started at the timing T2 in FIG. 19 but may be started after the timing T2). It is noted that the forward rotation of the conveying motor 102 may end simultaneously or after the end of the reverse rotation of the supply motor 101 on condition that the forward rotation of the conveying motor 102 ends before the start of the sliding processing (at T2 in FIG. 19).

The first rotating processing and the cap moving processing will be explained below.

As in the first embodiment, the rotating processing is a processing for rotating the clutch gear 190. The first rotating processing is a processing for rotating the first clutch gear 191 of the clutch gear 190.

The controller 130 rotates the conveying motor 102 forwardly such that the direction of this rotation is reverse to that of the last rotation (i.e., the reverse rotation) of the conveying motor 102 at S20 (T1-T3 in FIG. 19). As illustrated in FIG. 6, the forward driving force produced by the conveying motor 102 is transmitted to the first gear 191A of the first clutch gear 191 via the first transmitter 181, the roller gear 180, and the first slide gear 160A. Upon receiving the forward driving force, the first gear 191A is rotated to move the protrusion 194 away from the side surface 198B of the second gear 191B and toward the side surface 198A. The amount of this rotation of the first gear 191A is less than the above-described particular amount. Thus, the first gear 191A is rotated in the first rotating processing so as to establish a state in which the protrusion 194 is not in contact with the side surfaces 198A, 198B of the second gear 191B. As a result, the first gear 191A and the second gear 191B are allowed to idle with respect to each other.

The cap moving processing is a processing for lowering the movable member 111 being in contact with the lower surface of the recording head 39 at S20. The controller 130 rotates the supply motor 101 reversely (T1-T2 in FIG. 19). As in the processing at S20, the driving force produced by the supply motor 101 is transmitted to the cam mechanism 112. As a result, the movable member 111 is moved downward away from the lower surface of the recording head 39. In this movement, the cap 114 is moved from the covering position to the separated position. It is noted that the protrusion 144 of the second gear 192B and the side surface 148B of the first gear 192A are held in contact with each other as a result of the rotation of the second clutch gear 192 which is performed by the reverse rotation of the supply motor 101.

After the end of the cap moving processing, the controller 130 at S150 executes the second rotating processing (as another example of the rotating processing) and the sliding processing in parallel. Specifically, as illustrated in FIG. 19, the controller 130 rotates the supply motor 101 forwardly as the second rotating processing (at T2-T4 in FIG. 19) and at the same time rotates the carriage motor 103 forwardly in the sliding processing (at T2-T5 in FIG. 19). The forward rotation of the supply motor 101 rotates the second gear 192B until the first gear 192A and the second gear 192B can idle with respect to each other. The forward rotation of the carriage motor 103 moves the carriage 23 from the home position toward the printing area.

In the present embodiment, the controller 130 starts the second rotating processing and the sliding processing at the same time (at T2 in FIG. 19). It is noted that the controller 150 may start the sliding processing after the start of the second rotating processing. That is, the sliding processing is executed simultaneously or after the start of the second rotating processing.

There will be next explained the second rotating processing and the sliding processing.

The second rotating processing is a processing for rotating the second clutch gear 192 of the clutch gear 190.

The controller 130 rotates the supply motor 101 forwardly such that the direction of this rotation is reverse to that of the rotation of the supply motor 101 at S20 (T2-T4 in FIG. 19). As illustrated in FIG. 7, the forward driving force produced by the supply motor 101 is transmitted to the second gear 192B of the second clutch gear 192 via the second transmitter 182. Upon receiving the forward driving force, the second gear 192B is rotated to move the protrusion 144 away from the side surface 148B of the first gear 192A and toward the side surface 148A. As in the first rotating processing, an amount of this rotation of the second gear 192B is less than a particular amount. Here, the particular amount is an amount obtained by subtracting the length of the protrusion 144 of the second gear 192B in the circumferential directions 104 from the distance between the side surfaces 148A, 148B of the first gear 192A in the circumferential directions 104. Thus, the second gear 192B is rotated in the second rotating processing so as to establish a state in which the protrusion 144 is not in contact with the side surfaces 148A, 148B of the first gear 192A. As a result, the first gear 192A and the second gear 192B are allowed to idle with respect to each other.

It is noted that the amount of rotation of the second gear 192B and the position of the second gear 192B relative to the first gear 192A can be detected by a well-known means as in the case of the first clutch gear 191.

The sliding processing is for moving the slide gear 160 leftward from the right position RP. The controller 130 rotates the carriage motor 103 forwardly to move the carriage 23 from the home position toward the printing area (at T2-T5 in FIG. 19). That is, the carriage 23 is moved leftward from the home position. As a result, the slide gear 160 is moved toward the left position LP by the urging force of the first coil spring 168. Here, the first gear 191A is allowed to idle with respect to the second gear 191B by the first rotating processing, and the first gear 192A is allowed to idle with respect to the second gear 192B by the second rotating processing. This configuration enables smooth movement of the slide gear 160.

The controller 130 at S160 starts measuring a time elapsed from the end of the second rotating processing (at T4 in FIG. 19). The elapsed time may be measured using a timer circuit provided in the CPU 131 and may be measured by execution of a program for time measurement which is stored in the ROM 132, for example.

The controller 130 at S160 determines whether the elapsed time measured reaches a first particular length of time t1 (see FIG. 19) which will be described below. When the elapsed time reaches the first particular length of time t1 (S160: Yes), the controller 130 at S170 executes a forward and reverse rotation processing which will be described below (at T6-T8 in FIG. 19). The controller 130 executes the forward and reverse rotation processing simultaneously or after the start of the sliding processing (at T2 in FIG. 19). That is, the controller 130 at S170 executes the forward and reverse rotation processing simultaneously or after the start of the sliding processing (at T2 in FIG. 19), and after the first particular length of time t1 starting from the end of the second rotating processing (at T4 in FIG. 19).

As the first particular length of time t1 (at T4-T6 in FIG. 19) is set a length of time greater than or equal to a length of time required for movement of the slide gear 160 from the right position RP to the left position LP by the urging force of the first coil spring 168. The length of time required for movement of the slide gear 160 from the right position RP to the left position LP by the urging force of the first coil spring 168 can be obtained based on the spring constant of the first coil spring 168, the weight of the slide gear 160, and the distance between the right position RP and the left position LP in the right and left directions 9, for example.

The forward and reverse rotation processing at S170 (at T6-T8 in FIG. 19) includes a first forward and reverse rotation processing and a second forward and reverse rotation processing. In the first forward and reverse rotation processing, the controller 130 controls the conveying motor 102 to perform at least one forward rotation operation and at least one reverse rotation operation of the conveying motor 102 alternately. In the second forward and reverse rotation processing, the controller 130 controls the supply motor 101 to perform at least one forward rotation operation and at least one reverse rotation operation of the supply motor 101 alternately.

In the present embodiment, the first forward and reverse rotation processing and the second forward and reverse rotation processing are started at the same time (at T6 in FIG. 19) but may be started at different times.

For example, the first forward and reverse rotation processing may be started before the second forward and reverse rotation processing. In this case, the controller 130 measures a time elapsed from the end of the first rotating processing in addition to measuring the time elapsed from the end of the second rotating processing (at T4 in FIG. 19). The controller 130 starts the first forward and reverse rotation processing after not the first particular length of time t1 starting from the end of the second rotating processing (at T4 in FIG. 19) but a second particular length of time t2 starting from the end of the first rotating processing (at T3 in FIG. 19).

It is noted that even when the first forward and reverse rotation processing and the second forward and reverse rotation processing are started at the same time, the first forward and reverse rotation processing may be started after the second particular length of time t2 starting from the end of the first rotating processing (at T3 in FIG. 19). FIG. 19 indicates the second particular length of time t2 in this case.

In the present embodiment, the number of each of the forward rotation and the reverse rotation of the conveying motor 102 in the first forward and reverse rotation processing and the forward rotation and the reverse rotation of the supply motor 101 in the second forward and reverse rotation processing is one but may be two or more.

In the first forward and reverse rotation processing, the conveying motor 102 is first rotated in a direction that is reverse to a rotational direction of the conveying motor 102 for causing the sucking operation performed by the pump 113 of the maintenance mechanism 110 and is then rotated in the rotational direction coinciding with the rotational direction for causing the sucking operation. In the present embodiment, the sucking operation is performed by the pump 113 when the forward driving force produced by the conveying motor 102 is transmitted to the pump 113. In the present embodiment, accordingly, the conveying motor 102 performs the reverse rotation and then performs the forward rotation.

In the second forward and reverse rotation processing, the supply motor 101 is first rotated in a direction that is reverse to a rotational direction of the supply motor 101 for rotating the second supply roller 35 to supply the sheet 12 and moving the cap 114 of the maintenance mechanism 110 upward and downward, and then the supply motor 101 is rotated in the rotational direction for rotating the second supply roller 35 to supply the sheet 12 and moving the cap 114 of the maintenance mechanism 110 upward and downward. In the present embodiment, the second supply roller 35 and the cap 114 are respectively rotated and moved upward and downward by receiving the reverse driving force produced by the supply motor 101. In the present embodiment, accordingly, the supply motor 101 first performs the forward rotation and then performs the reverse rotation.

It is noted that in the case where the slide gear 160 has reached the left position LP without being caught by the receiving gears 165, 166 in the sliding processing at S150, when the supply motor 101 first performs the forward rotation and then performs the reverse rotation in the second forward and reverse rotation processing, the first supply roller 25 is rotated, by the forward rotation of the supply motor 101, in a direction for supplying the sheet 12 supported on the supply tray 20. As a result, the sheet 12 is supplied by a small distance corresponding to an amount of the rotation. However, the sheet 12 is to be supplied to the conveyance path 65 in a sheet supply processing at S180 which will be described below. Thus, there is no problem in the supply of the sheet 12 by a small amount in the forward and reverse rotation processing at S170.

In the case where the slide gear 160 is caught by the receiving gear 165 and thereby located at the right position RP without reaching the left position LP in the sliding processing at S150, the cap 114 is not moved upward or downward even when the supply motor 101 first performs the forward rotation and then performs the reverse rotation in the second forward and reverse rotation processing. This is because the cap 114 is not driven in the forward rotation of the supply motor 101 which is performed first, and the clutch gear 190 idles in the reverse rotation of the supply motor 101 which is performed later, and accordingly no power is transmitted to the cap 114.

In the case where the slide gear 160 is caught by the receiving gear 166 and thereby located at the central position MP without reaching the left position LP in the sliding processing at S150, the second supply roller 35 does not supply the sheet 12 even when the supply motor 101 first performs the forward rotation and then performs the reverse rotation in the second forward and reverse rotation processing. This is because the lifter 38 pivots to the non-supply position in the forward rotation of the supply motor 101 which is performed first, and the clutch gear 190 idles in the reverse rotation of the supply motor 101 which is performed later, and accordingly no power is transmitted to the second supply roller 35.

In the present embodiment, an amount of the reverse rotation of the conveying motor 102 which is performed first in the first forward and reverse rotation processing and an amount of the forward rotation of the supply motor 101 which is performed first in the second forward and reverse rotation processing are set as follows.

The amount of the reverse rotation of the conveying motor 102 which is performed first in the first forward and reverse rotation processing is an amount of rotation which rotates the first gear 191A of the first clutch gear 191 by an amount greater than or equal to a first particular amount. Here, the first particular amount is obtained by subtracting the length of the protrusion 194 of the first gear 191A in the circumferential directions 104 from the distance between the side surfaces 198A, 198B of the second gear 191B in the circumferential directions 104. As a result, the protrusion 194 is held in contact with the side surface 198B at the end of the reverse rotation of the conveying motor 102.

The amount of the forward rotation of the supply motor 101 which is performed first in the second forward and reverse rotation processing is an amount of rotation which rotates the second gear 192B of the second clutch gear 192 by an amount greater than or equal to a second particular amount. Here, the second particular amount is obtained by subtracting the length of the protrusion 144 of the second gear 192B in the circumferential directions 104 from the distance between the side surfaces 148A, 148B of the first gear 192A in the circumferential directions 104. As a result, the protrusion 144 is held in contact with the side surface 148A at the end of the forward rotation of the supply motor 101.

In the present embodiment, an amount of the forward rotation of the conveying motor 102 which is performed later in the first forward and reverse rotation processing and an amount of the reverse rotation of the supply motor 101 which is performed later in the second forward and reverse rotation processing are set as follows.

The amount of the forward rotation of the conveying motor 102 which is performed later in the first forward and reverse rotation processing is an amount of rotation which rotates the first gear 191A of the first clutch gear 191 by an amount less than the first particular amount. As a result, the protrusion 194 is not in contact with any of the side surfaces 198A, 198B at the end of the forward rotation of the conveying motor 102.

The amount of the reverse rotation of the supply motor 101 which is performed later in the second forward and reverse rotation processing is an amount of rotation which rotates the second gear 192B of the second clutch gear 192 by an amount less than the second particular amount. As a result, the protrusion 144 is not in contact with any of the side surfaces 148A, 148B at the end of the reverse rotation of the supply motor 101.

In the present embodiment, an amount of each of the forward rotation and the reverse rotation of the supply motor 101 in the second forward and reverse rotation processing is greater than or equal to an amount of rotation corresponding to an amount of a clearance between teeth of each of the second slide gear 160B, the first gear 192A, and the receiving gears 165, 166, 167. An amount of each of the forward rotation and the reverse rotation of the conveying motor 102 in the first forward and reverse rotation processing is greater than or equal to an amount of rotation corresponding to an amount of a clearance between teeth of each of the first slide gear 160A, the first gear 191A, and the roller gear 180.

In the present embodiment, in the forward and reverse rotation processing, the reverse rotation of the conveying motor 102 and the forward rotation of the supply motor 101 are started at the same time (at T6 in FIG. 19), the forward rotation of the conveying motor 102 and the reverse rotation of the supply motor 101 are started at the same time (at T7 in FIG. 19), and the forward rotation of the conveying motor 102 and the reverse rotation of the supply motor 101 are terminated at the same time (at T8 in FIG. 19). However, each set of the timings may not be the same as each other.

After the forward and reverse rotation processing at S170, the controller 130 executes the sheet supply processing at S180. In the sheet supply processing, the controller 130 rotates the supply motor 101 forwardly. This rotation rotates the first supply roller 25 forwardly, so that the sheet supported on the supply tray 20 is supplied to the conveyance path 65.

The sheet supplied into the conveyance path 65 is brought into contact with the conveying roller unit 54. The conveying motor 102 is rotated reversely or at rest at the timing when the sheet is brought into contact with the conveying roller unit 54. This operation corrects a skew of the sheet.

The processings at S190-S210 are the same as those at S80-S100 in the first embodiment, and an explanation of which is dispensed with.

To record an image on the sheet 12 supported on the MP tray 31, the controller 130 moves the carriage 23 rightward between S170 and S180 to move the slide gear 160 from the left position LP to the central position MP. In this case, the supply motor 101 is rotated reversely in the next sheet supply processing at S180 unlike the case where an image is recorded on the sheet supported on the supply tray 20. This rotation causes the lifter 38 to pivot toward the supply position, and the second supply roller 35 is rotated forwardly. As a result, the sheet 12 supported on the MP tray 31 is supplied to the conveyance path 65.

Effects in Second Embodiment

In the second embodiment, when the first rotating processing is executed by the controller 130, the protrusion 194 is not in contact with any of the side surfaces 198A, 198B. Thus, the first gear 191A of the first clutch gear 191 is rotatable by an amount of clearance between the protrusion 194 and each of the side surfaces 198A, 198B. Accordingly, it is possible to smoothly perform (i) the operation in which the slide gear 160 is slid to bring the first slide gear 160A into engagement with the first gear 191A, and (ii) the operation in which the first slide gear 160A being in mesh with the first gear 191A is slid and disengaged from the first gear 191A.

In the second embodiment, when the second rotating processing is executed by the controller 130, the protrusion 144 is not in contact with any of the side surfaces 148A, 148B. Thus, the first gear 192A of the second clutch gear 192 is rotatable by an amount corresponding to the clearance between the protrusion 144 and each of the side surfaces 148A, 148B. Accordingly, it is possible to smoothly perform (i) the operation in which the second slide gear 160B is brought into engagement with any of the receiving gears 165-167 in the state in which the second slide gear 160B and the first gear 192A are in mesh with each other and (ii) the operation in which the second slide gear 160B being in mesh with any of the receiving gears 165-167 is disengaged from any of the receiving gears 165-167.

However, there still is a possibility that the slide gear 160 being slid is caught by any of the first gears 191A, 192A and the receiving gears 165-167, and smooth sliding is thereby hindered.

In the second embodiment, to solve this problem, the forward and reverse rotation processing at S170 is executed simultaneously or after the start of the sliding processing at S150 and after the particular length of time t1 starting from the end of the second rotating processing S150 (S160: Yes). With this processing, even if the slide gear 160 is caught (snagged) by any of the first gears 191A, 192A and the receiving gears 165-167 in the sliding processing at S150, the forward and reverse rotation processing at S170 can release the catch of the slide gear 160 on any of the first gears 191A, 192A and the receiving gears 165-167. Moreover, the slide gear 160 is slid smoothly with high possibility because the first gears 191A, 192A are rotatable in most cases. Thus, only the minimum number of the forward rotation and the reverse rotation of the supply motor 101 and the conveying motor 102 is required in the forward and reverse rotation processing at S150. This processing expedites the sliding of the slide gear 160.

In the second embodiment, the second rotating processing and the sliding processing are started at the same time (S150, at T2 in FIG. 19). The sliding processing can be terminated earlier than in the case where the sliding processing is executed after the second rotating processing.

In the second embodiment, the amount of rotation of each of the conveying motor 102 and the supply motor 101 which is performed first in the forward and reverse rotation processing at S170 is greater than or equal to the particular amount. Also, the amount of rotation of each of the conveying motor 102 and the supply motor 101 which is performed later in the forward and reverse rotation processing at S170 is less than the particular amount. As a result, just after each of the supply motor 101 and the conveying motor 102 performs one of the forward rotation and the reverse rotation and thereafter performs the other in the forward and reverse rotation processing at S170, the protrusion 194 can be reliably disengaged from any of the side surfaces 198A, 198B, and the protrusion 144 can be reliably disengaged from any of the side surfaces 148A, 148B.

In the second embodiment, the cap 114 and the second supply roller 35 are driven by receiving the driving force produced by the reverse rotation of the supply motor 101. With this configuration, no driving force is transmitted from the second gear 192B to the first gear 192A in the reverse rotation performed later in the forward rotation and the reverse rotation of the supply motor 101 in the forward and reverse rotation processing at S170. Thus, no driving force is transmitted to the cap 114 and the second supply roller 35. This configuration can prevent the cap 114 and the second supply roller 35 from being driven unintentionally in the forward and reverse rotation processing.

In the second embodiment, the pump 113 of the maintenance mechanism 110 performs the sucking operation by receiving the driving force produced by the forward rotation of the conveying motor 102 and performs the air communicating operation by receiving the driving force produced by the reverse rotation of the conveying motor 102. Also, the pump 113 performs the air communicating operation in the reverse rotation performed first in the forward rotation and the reverse rotation of the conveying motor 102 in the forward and reverse rotation processing. No driving force is transmitted from the first gear 191A to the second gear 191B in the forward rotation performed later in the forward rotation and the reverse rotation of the conveying motor 102 in the forward and reverse rotation processing. Thus, no driving force is transmitted to the pump 113. This configuration prevents the pump 113 from unintentionally performing the sucking operation in the forward and reverse rotation processing.

In the second embodiment, when the carriage 23 is moved from the home position to the printing area in the sliding processing at S150, the first slide gear 160A is slid from the right position RP to the left position LP by the urging force of the first coil spring 168. Even if the first slide gear 160A is caught by the first gear 191A in this sliding, the forward and reverse rotation processing at S70 can release the catch of the first slide gear 160A on the first gear 191A.

In the second embodiment, when the carriage 23 is moved from the home position to the printing area in the sliding processing at S150, the second slide gear 160B is pressed by the first slide gear 160A and thereby slid from the right position RP to the left position LP. In this sliding, the urging force of the first coil spring 168 decreases with decrease in distance between the second slide gear 160B being slid and the left position LP. Thus, a possibility of the second slide gear 160B being caught by the receiving gear 167 is higher than a possibility of the second slide gear 160B being caught by the receiving gear 165. However, even if the second slide gear 160B is caught by the receiving gear 167, the forward and reverse rotation processing at S170 can release the catch of the second slide gear 160B on the receiving gear 167. Of course, the forward and reverse rotation processing at S170 can release the catch of the second slide gear 160B on any of the receiving gears 165, 166.

In the second embodiment, since the first rotating processing is executed during the execution of the cap moving processing (S40), the movement of the cap 114 and the rotation of the first clutch gear 191 are performed in parallel. This configuration can expedite the timings of the starts of the sliding processing at S150 and the forward and reverse rotation processing at S170.

In the second embodiment, the first forward and reverse rotation processing and the second forward and reverse rotation processing are started at the same time (at T6 in FIG. 19). Accordingly, the first forward and reverse rotation processing and the second forward and reverse rotation processing can be finished earlier than in the case where the start timings of the first forward and reverse rotation processing and the second forward and reverse rotation processing are different from each other.

In the second embodiment, the first particular length of time t1 is greater than or equal to the length of time required for movement of the slide gear 160 from the right position RP to the left position LP by the urging force of the first coil spring 168. Thus, the slide gear 160 can be slid from the right position RP to the left position LP during the first particular length of time t1. Also, even if the slide gear 160 is caught by any of the receiving gears 165-167 when the slide gear 160 is slid from the right position RP to the left position LP, the supply motor 101 or the conveying motor 102 can be rotated forwardly or reversely to release the catch of the slide gear 160 on any of the receiving gears 165-167.

First Modification

In the second embodiment, since the conveying motor 102 is rotated reversely for the air communicating operation of the pump 113 in the maintenance for the recording head 39, it is obvious that the protrusion 194 of the first gear 191A and the side surface 198B of the second gear 191B are held in contact with each other at the start of the first rotating processing. Thus, the conveying motor 102 is rotated only in one direction in the first rotating processing, that is, the conveying motor 102 is rotated only forwardly in the first rotating processing. This rotation rotates the first gear 191A so as to establish the state in which the protrusion 194 is not in contact with any of the side surfaces 198A, 198B of the second gear 191B. As a result, the first gear 191A and the second gear 191B are allowed to idle with respect to each other.

In the second embodiment, since the supply motor 101 is rotated reversely for the movement of the cap 114 in the maintenance for the recording head 39, it is obvious that the protrusion 144 of the second gear 192B and the side surface 148B of the first gear 192A are held in contact with each other at the start of the second rotating processing. Thus, the supply motor 101 is rotated only in one direction in the second rotating processing, that is, the supply motor 101 is rotated only forwardly in the second rotating processing. This rotation rotates the second gear 192B so as to establish the state in which the protrusion 144 is not in contact with any of the side surfaces 148A, 148B of the first gear 192A. As a result, the first gear 192A and the second gear 192B are allowed to idle with respect to each other.

In the second embodiment as described above, each of the conveying motor 102 and the supply motor 101 is rotated only in one direction in the rotating processing (the first rotating processing and the second rotating processing).

However, in the case where not the pump 113 but only the cap 114 is driven in the maintenance for the recording head 39, it is not obvious whether the protrusion 194 of the first gear 191A is held in contact with any of the side surfaces 198A, 198B of the second gear 191B at the start of the first rotating processing. Also, in the case where the maintenance for the recording head 39 is not performed (that is, the cap 114 is not driven), it is not obvious whether the protrusion 144 of the second gear 192B is held in contact with any of the side surfaces 148A, 148B of the first gear 192A at the start of the second rotating processing.

In this case, at least one of the conveying motor 102 and the supply motor 101 may be rotated in both of the forward and reverse directions in the rotating processing (the first rotating processing and the second rotating processing).

For example, the conveying motor 102 may be rotated reversely and then rotated forwardly in the first rotating processing.

An amount of the reverse rotation of the conveying motor 102 in this case is an amount of rotation greater than or equal to the first particular amount for the first gear 191A of the first clutch gear 191 in the second embodiment. Thus, the protrusion 194 is held in contact with the side surface 198B at the end of the reverse rotation of the conveying motor 102.

An amount of the forward rotation of the conveying motor 102 which is performed after its reverse rotation is an amount of rotation which rotates the first gear 191A of the first clutch gear 191 by an amount less than the first particular amount. As a result, the protrusion 194 is not in contact with any of the side surfaces 198A, 198B at the end of the forward rotation of the conveying motor 102.

In the above-described first rotating processing, the pump 113 performs the air communicating operation by the reverse rotation of the conveying motor 102 which is performed first, but the driving force produced by the forward rotation of the conveying motor 102 which is performed later is not transmitted to the pump 113. This configuration can prevent the pump 113 from unintentionally performing the sucking operation. It is noted that while the conveying motor 102 is rotated reversely and then rotated forwardly with consideration of the operation of the pump 113 in the first modification, the conveying motor 102 may be rotated forwardly and then rotated reversely.

Also, the supply motor 101 may be rotated forwardly and then rotated reversely in the second rotating processing, for example.

An amount of the forward rotation of the supply motor 101 in this case is an amount of rotation greater than or equal to the second particular amount for the second gear 192B of the second clutch gear 192 in the second embodiment. Thus, the protrusion 144 is held in contact with the side surface 148B at the end of the forward rotation of the supply motor 101.

An amount of the reverse rotation of the supply motor 101 which is performed after its forward rotation is an amount of rotation which rotates the second gear 192B of the second clutch gear 192 by an amount less than the second particular amount. As a result, the protrusion 144 is not in contact with any of the side surfaces 148A, 148B at the end of the reverse rotation of the supply motor 101.

In the above-described second rotating processing, transmission of the driving force produced by the reverse rotation of the supply motor 101 for moving the cap 114 and supplying the sheet 12 to the second supply roller 35 is hindered between the second gear 192B and the first gear 192A. This configuration can prevent the cap 114 and the second supply roller 35 from being unintentionally driven. While the supply motor 101 is rotated forwardly and then rotated reversely with consideration of the operation of the cap 114 and the second supply roller 35 in the first modification, the supply motor 101 may be rotated reversely and then rotated forwardly.

In the rotating processing (the first rotating processing and the second rotating processing) as described above, each of the conveying motor 102 and the supply motor 101 is rotated in both of the forward and reverse directions. Accordingly, even in the case where positions of the protrusions 194, 144 at the start of the rotating processing are not grasped, the first gears 191A, 192A and the respective second gears 191B, 192B are allowed to idle with respect to each other at the end of the rotating processing.

Second Modification

In the above-described embodiment, one forward rotation and one reverse rotation are performed by each of the conveying motor 102 and the supply motor 101 in the forward and reverse rotation processing. That is, the sum of the number of forward rotations of the supply motor 101 and the number of reverse rotations of the supply motor 101 in the forward and reverse rotation processing is two. The total number of the forward rotations and the reverse rotations is not limited to two. The total number is preferably greater than or equal to the number of receiving gears. For example, in the case where the three receiving gears 165-167 are provided as in the above-described embodiments, the total number is preferably three or more.

In the case where the second slide gear 160B is caught by any of the receiving gears 165-167, the second slide gear 160B can be rotated only once by forward rotation or reverse rotation of the supply motor 101 to release the catch of the second slide gear 160B on the receiving gear. Accordingly, in the case where the sum of the number of forward rotations of the supply motor 101 and the number of reverse rotations of the supply motor 101 in the forward and reverse rotation processing at S170 is greater than or equal to three as the number of the receiving gears 165-167, even if the second slide gear 160B is caught by all the receiving gears 165-167 during sliding, all the catches can be released.

Third Modification

In the above-described first and second embodiments, the driving-force transmitting mechanism 70 is used for both of the transmission of the driving force from the conveying motor 102 to the pump 113 and the transmission of the driving force from the supply motor 101 to the cam mechanism 112, the first supply roller 25, and the second supply roller 35. In the driving-force transmitting mechanism 70, the first slide gear 160A and the second slide gear 160B are held in contact with each other and moved in conjunction with each other. That is, the transmission of the driving force from the conveying motor 102 to the pump 113 and the transmission of the driving force from the supply motor 101 to the cam mechanism 112, the first supply roller 25, and the second supply roller 35 are related to each other.

However, the transmission of the driving force from the conveying motor 102 to the pump 113 and the transmission of the driving force from the supply motor 101 to the cam mechanism 112, the first supply roller 25, and the second supply roller 35 may be independent of each other. Also, the MFP 10 may include only a mechanism for transmitting the driving force from the conveying motor 102 to the pump 113 in the driving-force transmitting mechanism 70. Alternatively, the MFP 10 may include only a mechanism for transmitting the driving force from the supply motor 101 to the cam mechanism 112, the first supply roller 25, and the second supply roller 35 in the driving-force transmitting mechanism 70.

Figure 16A:
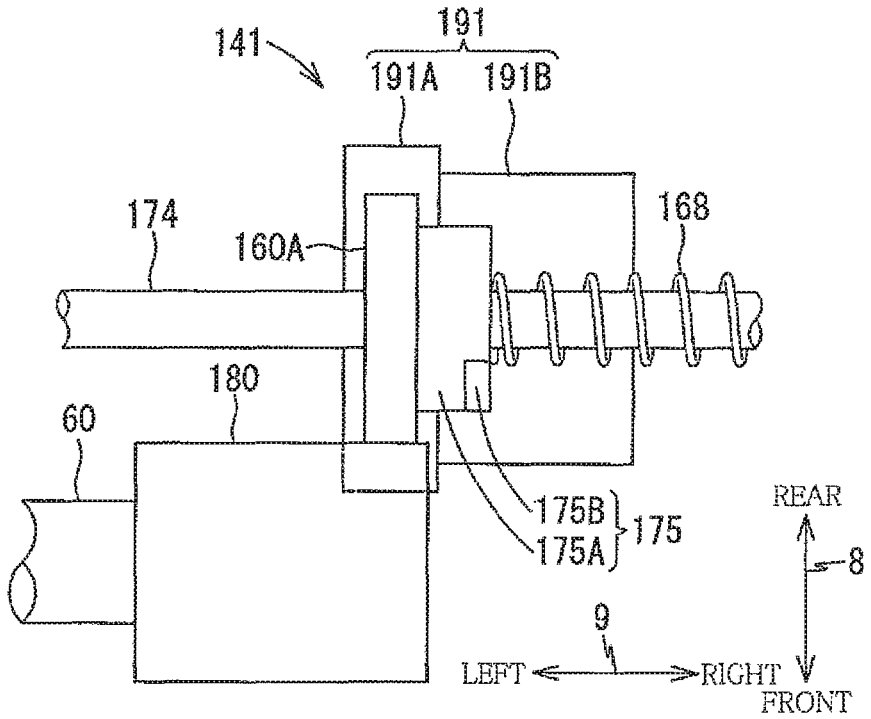
FIG. 16A is a schematic view of a mechanism in a modification.

In this modification, a mechanism 141 transmits the driving force from the conveying motor 102 to the pump 113. FIG. 16A illustrates this mechanism 141. That is, the mechanism 141 is constructed by removing the mechanism for transmitting the drive force from the supply motor 101 to the cam mechanism 112, the first supply roller 25, and the second supply roller 35, from the driving-force transmitting mechanism 70. It is noted that FIG. 16A illustrates a state in which the first slide gear 160A is located at the right position RP.

Figure 16B:
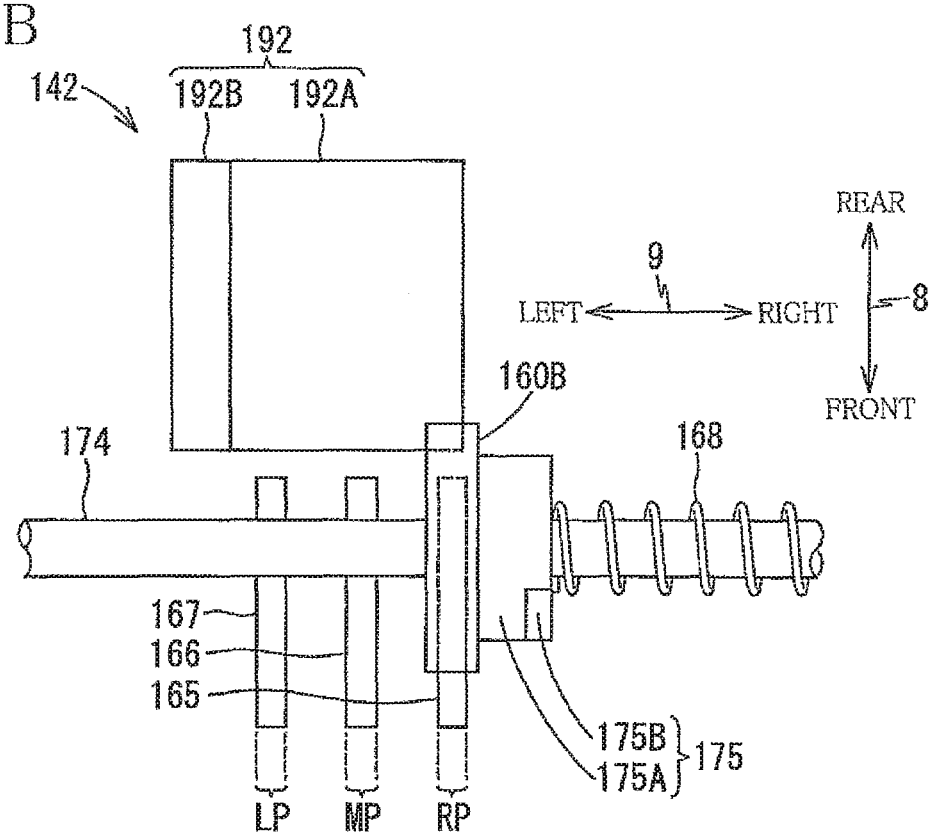
FIG. 16B is a schematic view of a mechanism in another modification.

Also, FIG. 16B illustrates a mechanism 142 for transmitting the driving force from the supply motor 101 to the cam mechanism 112, the first supply roller 25, and the second supply roller 35. That is, the mechanism 142 is constructed by removing the mechanism for transmitting the driving force from the conveying motor 102 to the pump 113, from the driving-force transmitting mechanism 70. It is noted that FIG. 16B illustrates a state in which the second slide gear 160B is located at the right position RP. The main body 175A of the lever member 175 is in contact with the second slide gear 160B in FIG. 16B.

Other Modifications

In the first and second embodiments, the contact members are the protrusions 194, 195, 144, 145 that are inserted in the respective recesses 198, 199, 148, 149. However, the shape of the contact member is not limited to the shape of each of the protrusions 194, 195, 144, 145 (see FIG. 14) in the first and second embodiments. For example, two protrusions may be provided on the right surface 193 of the first gear 191A so as to be protruded in the right direction and spaced apart from each other in the circumferential directions 104, and these protrusions may be inserted in the recess 198. In this case, each of the two protrusions is one example of the contact member. One of the two protrusions is contactable with the side surface 198A, and the other of the two protrusions is contactable with the side surface 198B. The distance in the circumferential directions 104 between a contact portion of one of the two protrusions which is to contact the side surface 198A and a contact portion of the other of the two protrusions which is to contact the side surface 198B is less than the distance between the side surfaces 198A, 198B in the circumferential directions 104.

The lever member 175 is disposed to the right of the first slide gear 160A in the above-described first and second embodiments but may be disposed at another position. For example, the lever member 175 may be disposed between the second slide gear 160B and the second coil spring 169.

The conveyor is installed in the printer 11 for recording an image on the sheet 12 in the above-described first and second embodiments but may be installed in a device different from the printer 11. For example, the conveyor may be installed in a scanner for reading an image on the sheet 12 in the MFP 10, for example.

What is claimed is:

1. A conveyor, comprising:

a slide gear supported slidably in axial directions of a support shaft;

a clutch gear comprising (i) a first gear meshable with the slide gear and (ii) a second gear that is rotated coaxially with the first gear;

a motor that applies a driving force to one of the second gear and the slide gear;

a driven member that is driven by the driving force transmitted from another of the second gear and the slide gear;

a sliding mechanism that slides the slide gear;

a roller that conveys a sheet by being rotated by the driving force transmitted from the motor; and a controller configured to control the motor and the sliding mechanism, wherein the clutch gear comprises:

a first surface and a second surface provided on one of the first gear and the second gear, the first surface and the second surface facing each other in circumferential directions of the one of the first gear and the second gear; and a contact member provided on another of the first gear and the second gear and located between the first surface and the second surface in the circumferential directions, the contact member being contactable with the first surface and the second surface, wherein a distance in the circumferential directions between a contact portion of the contact member which is to contact the first surface and a contact portion of the contact member which is to contact the second surface is less than a distance between the first surface and the second surface in the circumferential directions, and wherein the controller is configured to perform:

controlling the motor in a state in which the slide gear and the first gear are in mesh with each other, to cause rotation of the clutch gear to establish a state in which the contact member is not in contact with any of the first surface and the second surface; and controlling the sliding mechanism to cause sliding of the slide gear in the state in which the contact member is not in contact with any of the first surface and the second surface.

2. An ink-jet recording apparatus, comprising:

the conveyor according to claim 1;

a recording head configured to eject ink from at least one nozzle onto the sheet conveyed by the roller; and a carriage supporting the recording head and movable over a printing area and a home position, wherein the printing area is an area where the recording head is allowed to eject the ink onto the sheet, and the home position is located outside the printing area, wherein the axial directions are a first direction and a second direction as opposite directions, wherein the slide gear is slidable to (i) a first position at which the slide gear is in mesh with the first gear and (ii) a second position at which the slide gear is not in mesh with the first gear, and the second position is located on a first-direction side of the first position in the axial directions, wherein the sliding mechanism comprises:

the carriage;

an urging member that urges the slide gear in the first direction; and a lever member comprising a protrusion protruding into a moving area of the carriage, the lever member being slidably supported by the support shaft, the lever member being configured to keep the slide gear at the first position against an urging force of the urging member when the protrusion is in contact with the carriage located at the home position, and wherein the controller is configured to move the carriage from the home position toward the printing area to slide the slide gear.

3. The ink-jet recording apparatus according to claim 2, further comprising a roller gear provided on a roller shaft of the roller, the roller gear being rotatable together with the roller, the roller gear being meshable with the slide gear, wherein the motor is configured to apply the driving force to the slide gear via the roller gear, and wherein the roller gear is in mesh with the slide gear when the slide gear is located at any of the first position and the second position.

4. The ink-jet recording apparatus according to claim 2, wherein the driven member is a maintenance mechanism that is driven by the driving force transmitted from the second gear to perform maintenance of the recording head.

5. An ink-jet recording apparatus, comprising:

the conveyor according to claim 1;

a plurality of transmission gears spaced apart from each other in the axial directions and each meshable with the slide gear;

a recording head configured to eject ink from at least one nozzle onto the sheet conveyed by the roller; and a carriage supporting the recording head and movable over a printing area and a home position, wherein the printing area is an area where the recording head is allowed to eject the ink onto the sheet, and the home position is located outside the printing area, wherein the axial directions are a first direction and a second direction as opposite directions, wherein the plurality of transmission gears at least comprises:

a first transmission gear that transmits the driving force produced by the motor to the driven member; and a second transmission gear disposed on a first-direction side of the first transmission gear in the axial directions, the second transmission gear being configured to transmit the driving force produced by the motor to the roller, wherein the slide gear is slidable at least to (i) a first position at which the slide gear is in mesh with the first transmission gear and (ii) a second position at which the slide gear is in mesh with the second transmission gear, wherein the sliding mechanism comprises:

the carriage;

an urging member that urges the slide gear in the first direction; and a lever member comprising a protrusion protruding into a moving area of the carriage, the lever member being slidably supported by the support shaft, the lever member being configured to keep the slide gear at the first position against an urging force of the urging member when the protrusion is in contact with the carriage located at the home position, and wherein the controller is configured to move the carriage from the home position toward the printing area to slide the slide gear.

6. The ink-jet recording apparatus according to claim 5, wherein the motor is configured to apply the driving force to the second gear, and wherein the first gear is in mesh with the slide gear regardless of position of the slide gear.

7. The ink-jet recording apparatus according to claim 5, wherein the roller is a supply roller that supplies the sheet supported by a tray, to a conveyance path formed in the conveyor.

8. The ink-jet recording apparatus according to claim 5, wherein the driven member is a cap that is driven by the driving force transmitted from the motor to be moved between (i) a covering position at which the cap covers the at least one nozzle of the recording head mounted on the carriage located at the home position and (ii) a separated position at which the cap is spaced apart from the at least one nozzle.

9. The ink-jet recording apparatus according to claim 5, wherein a distance between adjacent two of the plurality of transmission gears in the axial directions is greater than a length of the slide gear in the axial directions.

10. An ink-jet recording apparatus, comprising:

the conveyor according to claim 1;

a plurality of transmission gears spaced apart from each other in the axial directions;

a recording head configured to eject ink from at least one nozzle onto the sheet conveyed by the roller; and a carriage supporting the recording head and movable over a printing area and a home position, wherein the printing area is an area where the recording head is allowed to eject the ink onto the sheet, and the home position is located outside the printing area, wherein the axial directions are a first direction and a second direction as opposite directions, wherein the slide gear comprises:

a first slide gear; and a second slide gear meshable with each of the plurality of transmission gears and being in contact with the first slide gear, the second slide gear being disposed on a first-direction side of the first slide gear in the axial directions, wherein the conveyor further comprises a plurality of rollers each as the roller, and the plurality of rollers comprises:

a supply roller that supplies the sheet supported by a tray, to a conveyance path formed in the conveyor; and a conveying roller that conveys the sheet by being rotated in a state in which the conveying roller is in contact with the sheet on the conveyance path, wherein the conveyor further comprises a roller gear provided on a roller shaft of the conveying roller, the roller gear being rotatable together with the conveying roller, the roller gear being meshable with the first slide gear, wherein the clutch gear comprises:

a first clutch gear meshable with the first slide gear; and a second clutch gear meshable with the second slide gear, wherein the conveyor further comprises a plurality of motors each as the motor, and the plurality of motors comprises:

a first motor configured to apply the driving force to the first slide gear via the roller gear; and a second motor configured to apply the driving force to the second gear of the second clutch gear, wherein the conveyor further comprises a plurality of driven members each as the driven member, and the plurality of driven members comprises:

a first driven member that is driven by the driving force transmitted from the second gear of the first clutch gear; and a second driven member that is driven by the driving force transmitted from the second motor, wherein the plurality of transmission gears at least comprises:

a first transmission gear that transmits the driving force produced by the second motor to the second driven member; and a second transmission gear that is disposed on a first-direction side of the first transmission gear in the axial directions and that transmits the driving force produced by the second motor to the supply roller, wherein the slide gear is slidable at least to (i) a first position at which the first slide gear is in mesh with the first gear of the first clutch gear, and the second slide gear is in mesh with the first transmission gear and (ii) a second position at which the first slide gear is disengaged from the first gear of the first clutch gear, and the second slide gear is in mesh with the second transmission gear, wherein the roller gear is in mesh with the first slide gear regardless of position of the slide gear, wherein the first gear of the second clutch gear is in mesh with the second slide gear regardless of position of the slide gear, wherein the sliding mechanism comprises:

the carriage;

a lever member comprising a protrusion protruding into a moving area of the carriage, the lever member being slidably supported by the support shaft, the lever member being in contact with the first slide gear, the lever member being disposed on a second-direction side of the first slide gear in the axial directions;

a first urging member that urges the lever member in the first direction; and a second urging member that urges the second slide gear in the second direction by an urging force that is less than an urging force of the first urging member, wherein the first slide gear is kept at the first position against the urging force of the first urging member when the protrusion is in contact with the carriage located at the home position, wherein the first slide gear is moved to the second position by the urging force of the first urging member when the carriage is moved off the protrusion, and wherein the controller is configured to move the carriage from the home position toward the printing area to slide the slide gear.

11. The ink-jet recording apparatus according to claim 10, wherein the first driven member is a maintenance mechanism that is driven by the driving force transmitted from the second gear of the first clutch gear to perform maintenance of the recording head, and wherein the second driven member is a cap that is driven by the driving force transmitted from the second motor to be moved between (i) a covering position at which the cap covers the at least one nozzle of the recording head mounted on the carriage located at the home position and (ii) a separated position at which the cap is spaced apart from the at least one nozzle.

12. The ink-jet recording apparatus according to claim 11, wherein the controller is configured to, when the controller is moving the cap from the covering position to the separated position by controlling the second motor in a state in which the carriage is located at the home position, and the cap is located at the covering position, control the second motor in the state in which the slide gear and the first gear are in mesh with each other, to rotate the clutch gear to establish the state in which the contact member is not in contact with any of the first surface and the second surface, and wherein the controller is configured to control the sliding mechanism to slide the slide gear when a state in which the cap is located at the separated position, and the state in which the contact member is not in contact with any of the first surface and the second surface are established.

13. The ink-jet recording apparatus according to claim 11, wherein the controller is configured to, when the controller is moving the cap from the covering position to the separated position by controlling the second motor in a state in which the carriage is located at the home position, and the cap is located at the covering position, control the first motor in a state in which the first slide gear and the first gear of the first clutch gear are in mesh with each other, to rotate the first clutch gear to establish the state in which the contact member is not in contact with any of the first surface and the second surface, wherein the controller is configured to control the second motor in a state in which the cap is located at the separated position and in a state in which the second slide gear and the first gear of the second clutch gear are in mesh with each other, to rotate the second clutch gear to establish the state in which the contact member is not in contact with any of the first surface and the second surface, and wherein the controller is configured to slide the slide gear by controlling the sliding mechanism in the state in which the contact member is not in contact with any of the first surface and the second surface.

14. The conveyor according to claim 1, wherein the controller is configured to control the motor to perform at least one forward rotation operation and at least one reverse rotation operation of the motor during sliding of the slide gear and after a first period starting from an end of the rotation of the clutch gear which is caused to establish the state in which the contact member is not in contact with any of the first surface and the second surface.

15. The conveyor according to claim 14, wherein the controller is configured to control (i) the rotation of the clutch gear which is caused to establish the state in which the contact member is not in contact with any of the first surface and the second surface and (ii) the sliding of the slide gear.

16. The conveyor according to claim 14, wherein the controller is configured to:

set an amount of rotation of the motor which is performed first among the forward rotation operation and the reverse rotation operation of the motor, to an amount of rotation greater than equal to an amount of rotation which corresponds to a distance obtained by subtracting a distance in the circumferential directions between the contact portion of the contact member which is to contact the first surface and the contact portion of the contact member which is to contact the second surface, from the distance between the first surface and the second surface in the circumferential directions; and set an amount of rotation of the motor which is performed later among the forward rotation operation and the reverse rotation operation of the motor, to an amount of rotation less than the amount of rotation which corresponds to the distance obtained by subtracting the distance in the circumferential directions between the contact portion of the contact member which is to contact the first surface and the contact portion of the contact member which is to contact the second surface, from the distance between the first surface and the second surface in the circumferential directions.

17. The conveyor according to claim 16, wherein the driven member is configured to be driven by receiving a driving force produced by the rotation operation of the motor which is performed later among the forward rotation operation and the reverse rotation operation of the motor, and wherein the roller is configured to be rotated to convey the sheet by receiving the driving force produced by the rotation operation of the motor which is performed later among the forward rotation operation and the reverse rotation operation of the motor.

18. An ink-jet recording apparatus, comprising:

the conveyor according to claim 14;

a plurality of transmission gears spaced apart from each other in the axial directions;

a recording head configured to eject ink from at least one nozzle onto the sheet conveyed by the roller; and a carriage supporting the recording head and movable over a printing area and a home position, wherein the printing area is an area where the recording head is allowed to eject the ink onto the sheet, and the home position is located outside the printing area, wherein the axial directions are a first direction and a second direction as opposite directions, wherein the slide gear comprises:

a first slide gear; and a second slide gear meshable with each of the plurality of transmission gears and being in contact with the first slide gear, the second slide gear being disposed on a first-direction side of the first slide gear in the axial directions, wherein the conveyor further comprises a plurality of rollers each as the roller, and the plurality of rollers comprises:

a supply roller that supplies the sheet supported by a tray, to a conveyance path formed in the conveyor; and a conveying roller that conveys the sheet by being rotated in a state in which the conveying roller is in contact with the sheet on the conveyance path, wherein the conveyor further comprises a roller gear provided on a roller shaft of the conveying roller, the roller gear being rotatable together with the conveying roller, the roller gear being meshable with the first slide gear, wherein the clutch gear comprises:

a first clutch gear meshable with the first slide gear; and a second clutch gear meshable with the second slide gear, wherein the conveyor further comprises a plurality of motors each as the motor, and the plurality of motors comprises:

a first motor configured to apply the driving force to the first slide gear via the roller gear; and a second motor configured to apply the driving force to the second gear of the second clutch gear, wherein the conveyor further comprises a plurality of driven members each as the driven member, and the plurality of driven members comprises:

a first driven member that is driven by the driving force transmitted from the second gear of the first clutch gear; and a second driven member that is driven by the driving force transmitted from the second motor, wherein the plurality of transmission gears at least comprises:

a first transmission gear that transmits the driving force produced by the second motor to the second driven member; and a second transmission gear that is disposed on a first-direction side of the first transmission gear in the axial directions and that transmits the driving force produced by the second motor to the supply roller, wherein the slide gear is slidable at least to (i) a first position at which the first slide gear is in mesh with the first gear of the first clutch gear, and the second slide gear is in mesh with the first transmission gear and (ii) a second position at which the first slide gear is disengaged from the first gear of the first clutch gear, and the second slide gear is in mesh with the second transmission gear, wherein the roller gear is in mesh with the first slide gear regardless of position of the slide gear, wherein the first gear of the second clutch gear is in mesh with the second slide gear regardless of position of the slide gear, wherein the sliding mechanism comprises:

the carriage;

a lever member comprising a protrusion protruding into a moving area of the carriage, the lever member being slidably supported by the support shaft, the lever member being in contact with the first slide gear, the lever member being disposed on a second-direction side of the first slide gear in the axial directions;

a first urging member that urges the lever member in the first direction; and a second urging member that urges the second slide gear in the second direction by an urging force that is less than an urging force of the first urging member, wherein the first slide gear is kept at the first position against the urging force of the first urging member when the protrusion is in contact with the carriage located at the home position, wherein the first slide gear is moved to the second position by the urging force of the first urging member when the carriage is moved off the protrusion, wherein the controller is configured to move the carriage from the home position toward the printing area to slide the slide gear, wherein the first driven member is a maintenance mechanism that is driven by the driving force transmitted from the second gear of the first clutch gear to perform maintenance of the recording head, wherein the second driven member is a cap that is driven by the driving force transmitted from the second motor to be moved between (i) a covering position at which the cap covers the at least one nozzle of the recording head mounted on the carriage located at the home position and (ii) a separated position at which the cap is spaced apart from the at least one nozzle, wherein the controller is configured to, when the controller is moving the cap from the covering position to the separated position by controlling the second motor in a state in which the carriage is located at the home position, and the cap is located at the covering position, control the first motor in a state in which the first slide gear and the first gear of the first clutch gear are in mesh with each other, to cause rotation of the first clutch gear to establish the state in which the contact member is not in contact with any of the first surface and the second surface, wherein the controller is configured to control the second motor in a state in which the cap is located at the separated position and in a state in which the second slide gear and the first gear of the second clutch gear are in mesh with each other, to cause rotation of the second clutch gear to establish the state in which the contact member is not in contact with any of the first surface and the second surface, wherein the controller is configured to slide the slide gear by controlling the sliding mechanism in the state in which the contact member is not in contact with any of the first surface and the second surface, wherein the controller is configured to control the first motor to perform at least one forward rotation operation and at least one reverse rotation operation of the first motor during sliding of the slide gear and after a second period, as the first period, which starts from an end of the rotation of the first clutch gear which is caused to establish the state in which the contact member is not in contact with any of the first surface and the second surface, and wherein the controller is configured to control the second motor to perform at least one forward rotation operation and at least one reverse rotation operation of the second motor during sliding of the slide gear and after a third period, as the first period, which starts from an end of the rotation of the second clutch gear which is caused to establish the state in which the contact member is not in contact with any of the first surface and the second surface.

19. The ink-jet recording apparatus according to claim 18, wherein the controller is configured to start the at least one forward rotation operation and the at least one reverse rotation operation of the first motor and the at least one forward rotation operation and the at least one reverse rotation operation of the second motor simultaneously.

20. An ink-jet recording apparatus, comprising:

the conveyor according to claim 14;

a plurality of transmission gears spaced apart from each other in the axial directions and each meshable with the slide gear;

a recording head configured to eject ink from at least one nozzle onto the sheet conveyed by the roller; and a carriage supporting the recording head and movable over a printing area and a home position, wherein the printing area is an area where the recording head is allowed to eject the ink onto the sheet, and the home position is located outside the printing area, wherein the axial directions are a first direction and a second direction as opposite directions, wherein the plurality of transmission gears at least comprises:

a first transmission gear that transmits the driving force produced by the motor to the driven member; and a second transmission gear disposed on a first-direction side of the first transmission gear in the axial directions, the second transmission gear being configured to transmit the driving force produced by the motor to the roller, wherein the slide gear is slidable at least to (i) a first position at which the slide gear is in mesh with the first transmission gear and (ii) a second position at which the slide gear is in mesh with the second transmission gear, wherein the sliding mechanism comprises:

the carriage;

an urging member that urges the slide gear in the first direction; and a lever member comprising a protrusion protruding into a moving area of the carriage, the lever member being slidably supported by the support shaft, the lever member being configured to keep the slide gear at the first position against an urging force of the urging member when the protrusion is in contact with the carriage located at the home position, wherein the controller is configured to move the carriage from the home position toward the printing area to slide the slide gear, and wherein a sum of the number of the at least one forward rotation operation of the motor and the number of the at least one reverse rotation operation of the motor for transmission of the driving force to any one of the plurality of transmission gears is greater than or equal to the number of the plurality of transmission gears.

21. An ink-jet recording apparatus, comprising:

the conveyor according to claim 14;

a plurality of transmission gears spaced apart from each other in the axial directions and each meshable with the slide gear;

a recording head configured to eject ink from at least one nozzle onto the sheet conveyed by the roller; and a carriage supporting the recording head and movable over a printing area and a home position, wherein the printing area is an area where the recording head is allowed to eject the ink onto the sheet, and the home position is located outside the printing area, wherein the axial directions are a first direction and a second direction as opposite directions, wherein the plurality of transmission gears at least comprises:

a first transmission gear that transmits the driving force produced by the motor to the driven member; and a second transmission gear disposed on a first-direction side of the first transmission gear in the axial directions, the second transmission gear being configured to transmit the driving force produced by the motor to the roller, wherein the slide gear is slidable at least to (i) a first position at which the slide gear is in mesh with the first transmission gear and (ii) a second position at which the slide gear is in mesh with the second transmission gear, wherein the sliding mechanism comprises:

the carriage;

an urging member that urges the slide gear in the first direction; and a lever member comprising a protrusion protruding into a moving area of the carriage, the lever member being slidably supported by the support shaft, the lever member being configured to keep the slide gear at the first position against an urging force of the urging member when the protrusion is in contact with the carriage located at the home position, wherein the controller is configured to move the carriage from the home position toward the printing area to slide the slide gear, wherein the first transmission gear is disposed on a most upstream side in the first direction among the plurality of transmission gears, wherein the second transmission gear is disposed on a most downstream side in the first direction among the plurality of transmission gears, and wherein the first period is a period greater than or equal to a length of time required for the slide gear to be moved from the first position to the second position by the urging force of the urging member.

* * * * *